US007980649B2

(12) United States Patent
Konno et al.

(10) Patent No.: US 7,980,649 B2
(45) Date of Patent: Jul. 19, 2011

(54) APPARATUS AND METHOD OF INK JET PRINTING

(75) Inventors: Yuji Konno, Kawasaki (JP); Hiroshi Tajika, Yokohama (JP); Takeshi Yazawa, Yokohama (JP); Yoshito Mizoguchi, Kawasaki (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 631 days.

(21) Appl. No.: 11/953,453

(22) Filed: Dec. 10, 2007

(65) Prior Publication Data

US 2008/0143772 A1 Jun. 19, 2008

(30) Foreign Application Priority Data

Dec. 15, 2006 (JP) ..... 2006-338099

(51) Int. Cl.
*B41J 2/05* (2006.01)

(52) U.S. Cl. ..... 347/16; 347/5; 347/19

(58) Field of Classification Search ..... 347/5, 9, 347/12, 16, 40, 42, 14, 19
See application file for complete search history.

(56) References Cited

U.S. PATENT DOCUMENTS

| | | | | |
|---|---|---|---|---|
| 5,274,395 | A | 12/1993 | Mizoguchi et al. | |
| 5,745,135 | A * | 4/1998 | Hirabayashi et al. | 347/16 |
| 6,592,203 | B1 * | 7/2003 | Bates et al. | 347/40 |
| 2007/0273720 | A1 | 11/2007 | Yasutani et al. | |
| 2008/0143776 | A1 | 6/2008 | Konno et al. | |

FOREIGN PATENT DOCUMENTS

| | | |
|---|---|---|
| JP | 07-164643 | 6/1995 |
| JP | 2005-288909 | 10/2005 |

* cited by examiner

*Primary Examiner* — Lam S Nguyen

(74) *Attorney, Agent, or Firm* — Fitzpatrick, Cella, Harper & Scinto

(57) ABSTRACT

An apparatus and method of ink jet printing is provided that poor ejection less occurs even where making a printing on a printing medium ready to cause a paper powder, such as a fine art paper. An image is to be printed on a printing medium by performing a relative movement of a printing medium and a printing head having a plurality of arrays each having a plurality of ejection openings. On this occasion, the image is printed by using ejection openings in a number changed in accordance with a type of the printing medium, out of a plurality of ejection openings on the two arrays adjacent to each other.

7 Claims, 27 Drawing Sheets

| | NUMBER OF NON-EJECTION OPENINGS | |
|---|---|---|
| | USUAL PRINTING | DIVISIONAL PRINTING |
| LM | 2 | 0 |
| K1 | 2 | 0 |
| K2 | 0 | 0 |
| LC | 4 | 0 |
| Gray | 0 | 0 |
| Y | 0 | 0 |
| M | 6 | 0 |
| G | 3 | 0 |
| R | 0 | 0 |
| C | 1 | 0 |
| TOTAL | 18 | 0 |

FIG.25

APPARATUS AND METHOD OF INK JET PRINTING

BACKGROUND OF THE INVENTION

1. Field of the Invention

The present invention relates to an apparatus and method of ink jet printing, and more particularly to an apparatus and method of ink jet printing with using ink ejection openings in accordance with the type of a printing medium.

2. Description of the Related Art

Recently, the ink jet printing apparatus has become capable of making a printing in a quality not inferior to the film photograph besides outputting an in-office document through use of mainly a plain paper. This greatly relies upon density increase of the ink jet printing head, droplet size reduction, development of photographic printing medium and evolution of image processing. Meanwhile, image forming is conventionally by use of dye based ink whereas pigmented ink has been recently developed and being used for the purpose of outputting a photograph. The development of pigmented ink allows for improving image substantiality.

In conjunction with the improvement of image substantiality, the ink jet printing apparatuses are now being spread rapidly in the application of producing fine artworks. Fine art refers to a world that a subject matter such as of photograph or painting is printed on an exclusive medium for fine art and the output thereof is exhibited or marketed as an artwork. Accordingly, in producing a fine artwork, there is an importance in the durability not only of ink but also of printing paper.

In order to realize a long-term storage, the printing paper employs a structure having a material, such as a neutral paper or a cotton paper, used as a base material and an ink acceptance layer formed thereon. Furthermore, concave-convex is provided in the surface, to represent a unique texture like a painting paper or canvas. In addition, by increase the paper thickness greater than the existing ink jet paper, paper texture is improved. In this manner, various types of exclusive papers for fine art are under marketing. Specifically, the printing paper available is comparatively thick and elastic, e.g. basis weight ranges from approximately 200 g to approximately 300 g per square meter while paper thickness is from approximately 0.3 mm to 0.5 mm.

Such a fine art paper is ready to produce a paper powder from the paper surface or paper end thereof. Due to this, there is a possibility that the paper powder adheres to the paper feeding roller used in a paper feeding mechanism with a result that a poor paper feed is caused by a reduced friction force. There is also a possibility that a paper powder adheres to the vicinity of an ejection opening of the printing head thus resulting in poor ejection, e.g. ink is not to be ejected, ink ejection is deflected in direction or ink ejection is reduced in amount (hereinafter, referred also to as non-ejection phenomenon). Due to the occurrence of such non-ejection phenomenon, such a stripe as blanked white possibly appears on an image during printing.

In the vicinity of an ejection opening of the printing head, an ink mist caused upon ejection might adhere to the vicinity of an ejection opening besides a paper power, to cause a non-ejection phenomenon through blockage against ejection similarly to the paper powder case. Such a mist includes so-called a floating mist being suspended in the printing apparatus by printing. Besides, there is so-called a splash mist that the ink arrived at a paper surface is splashed and put on a surface of the printing head. In order to remove a paper powder or mist thus adhered to the vicinity of an ejection opening, the existing ink jet printing apparatus is provided with a mechanism that wipes a surface having ejection openings of the printing head. It is a general practice to perform wiping periodically or in proper timing (see Japanese Patent Laid-Open No. H07-164643).

However, because a paper powder frequently leads to a non-ejection phenomenon as compared to a mist when adhered to the vicinity of an ejection opening of the printing head, wiping only is insufficient as a countermeasure. Namely, the mist has a particle size of several μm while the paper powder occurring from a fine-art exclusive paper is in a size of several hundred μm. Non-ejection phenomenon is readily caused by a mere adhesion of one particle of paper powder. Accordingly, there is a need not to produce a paper powder or not to cause a paper powder to soar from a paper surface toward a printing head surface.

In the meanwhile, in the recent ink jet printing apparatus, a plurality of ejection openings are densely arranged in order to realize a quality, high-speed printing, which in many cases employ a printing head arranged with a plurality of ejection openings in a staggered two-array form. However, where performing an ejection of ink at the two arrays of ejection openings at the same time, two arrays of airflows are caused correspondingly to the ejection-opening arrays by the ejection. At this time, by the airflow, pressure is reduced in a space between the two arrays of ejection openings, to cause an airflow soaring in a direction from the paper surface toward the surface having ejection openings of the printing head. This resultingly makes it easy to raise a powder and splashing mist present on the paper surface. Meanwhile, the space between the two arrays of ejection openings is confined by the two arrays of airflows so that the paper powder and mist is placed in a state not easy to escape to the outside. Thus, there is a fear that the paper powder or mist adheres to the surface having ejection openings of the printing head.

In order to avoid the influence of the airflow as caused by a pressure-reduction effect occurring between the two arrays of ejection openings, Japanese Patent Laid-Open No. 2005-288909, for example, discloses an art that changes the array of ejection opening for use is changed in accordance with the printing duty of an image. According to this art, when the printing duty is low, printing is by use of two arrays of ejection openings at the same time. When the printing duty is high, the two arrays of ejection openings are used one array per time, to reduce the influence of the airflow between the two arrays of ejection openings.

However, there encounters a case that it takes uselessly long in printing even where adopting the method described in Japanese Patent Laid-Open No. 2005-288909 in an attempt to relieve the occurrence of paper powder. Namely, according to the method described in Japanese Patent Laid-Open No. 2005-288909, the array of ejection openings for use is indiscriminately restricted at a high print duty regardless of whether a printing medium is ready to cause a paper powder or not ready to cause a paper powder. However, with a printing medium not ready to cause a paper powder, the necessity is low in restricting the array of ejection openings in order to relieve the paper powder because a paper powder is less caused or is slight in amount even if caused even at a high printing duty. Therefore, it is not effective to employ the method described in Japanese Patent Laid-Open No. 2005-288909 where to relieve the paper powder.

SUMMARY OF THE INVENTION

It is an object of the present invention to provide an apparatus and method of ink jet printing that poor ejection less occurs even where making a printing on a printing medium ready to cause a paper powder, such as a fine art paper.

According to a first aspect of the present invention, there is provided an ink jet printing apparatus for printing an image on a printing medium by using a printing head having a plurality of arrays each having a plurality of ink ejection openings arranged, the apparatus comprising: a moving device that performs a relative movement of the printing medium and the printing head in a direction intersecting with an arrangement direction of the ink ejection openings; and a printing device for printing an image during the relative movement by using ink ejection openings in a number changed in accordance with a type of the printing medium, out of a plurality of ink ejection openings on the two arrays adjacent along the direction intersecting with the arrangement direction of the ink ejection openings.

According to a second aspect of the invention, there is provided an ink jet printing method for printing an image on a printing medium by performing a relative movement of a printing medium and a printing head having a plurality of arrays each having a plurality of ink ejection openings arranged, in a direction intersecting with an arrangement direction of the ink ejection openings, the method comprising: a step of determining a type of the printing medium; a step of determining an ink ejection opening for use in printing out of a plurality of ink ejection openings on the two arrays adjacent along the direction intersecting with the arrangement direction of the ink ejection openings, in accordance with the determined type of the printing medium; and a step of printing an image during the relative movement by using the determined ink ejection opening, wherein the ejection openings determined in the determination step is different in the number in accordance with the determined type of the printing medium.

The ink jet printing apparatus in the invention is to restrict the number of ink ejection openings for use in printing, for a printing medium ready to cause a scattering substance, such as a paper powder. As a result, a paper powder, etc. is relieved from adhering to a surface having ejection opening due to a soaring airflow caused by ejection. Meanwhile, because there is no need to increase the number of passes in multi-pass print greater than that required, printing is possible at high speed while keeping the image high in quality.

Further features of the present invention will become apparent from the following description of exemplary embodiments with reference to the attached drawings.

BRIEF DESCRIPTION OF THE DRAWINGS

FIG. 25 is a figure explaining what degree decreased is the occurrence of non-ejection due to paper powder adhesion where printing is made by the printing method according to the present embodiment of the invention;

DESCRIPTION OF THE EMBODIMENTS

Figure 1:
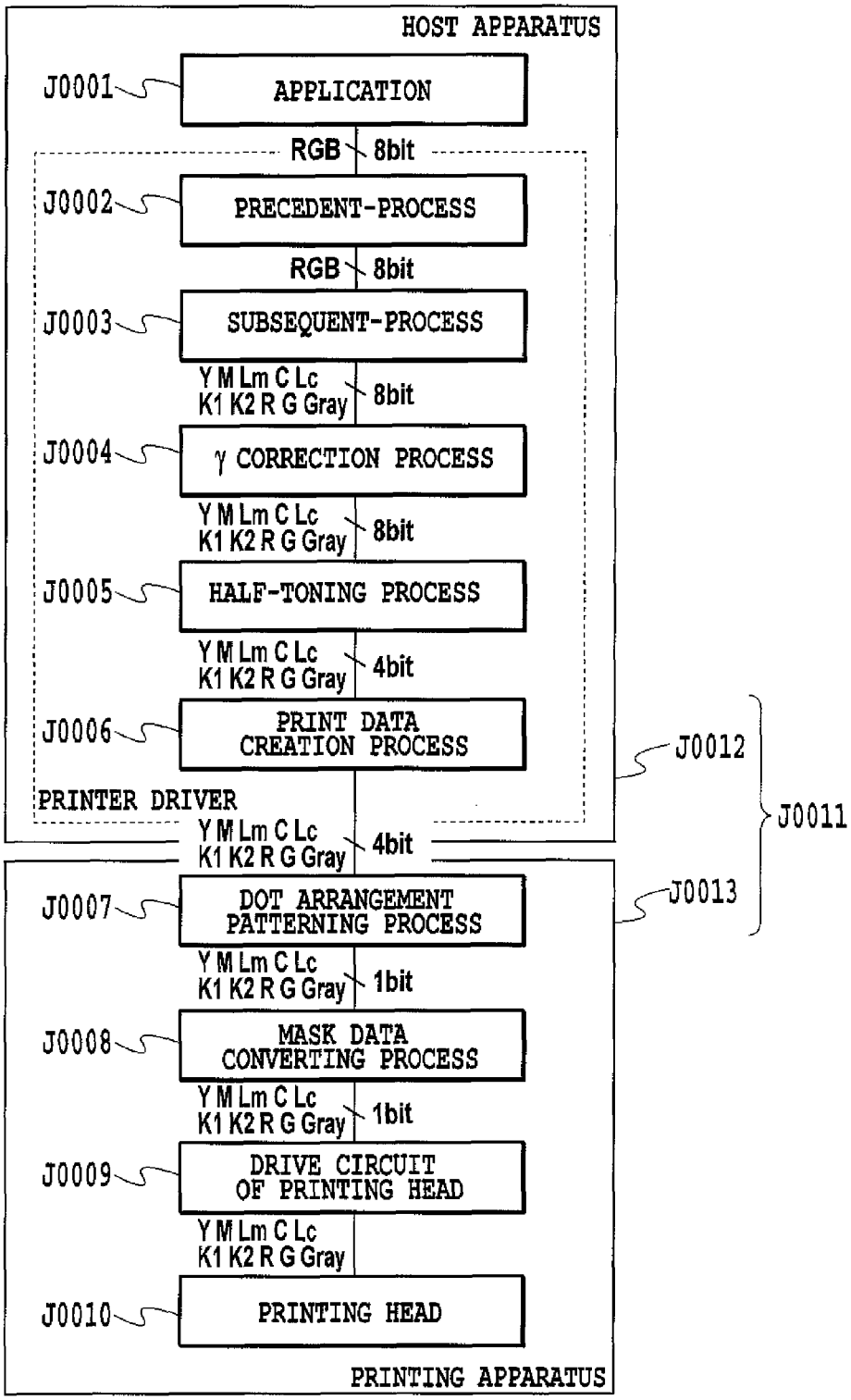
FIG. 1 is a diagram for explaining a flow in which image data are processed in a printing system to which an embodiment of the present invention is applied.

Descriptions will be provided below for embodiments of the present invention by referring to the drawings.

First Embodiment

1. Outline of Printing System

FIG. 1 is a diagram for explaining a flow in which image data are processed in a printing system to which an embodiment of the present invention is applied. This printing system J0011 includes a host apparatus J0012 which generates image data indicating an image to be printed, and which sets up a user interface (UI) for generating the data and so on. In addition, the printing system J0011 includes a printing apparatus J0013 which prints an image on a printing medium on the basis of the image data generated by the host apparatus J0012.

The printing apparatus J0013 performs a printing operation by use of 10 color inks of cyan (C), light cyan (Lc), magenta (M), light magenta (Lm), yellow (Y), red (R), green (G), black 1 (K1), black 2 (K2) and gray (Gray). To this end, a printing head H1001 for ejecting these 10 color inks is used for the printing apparatus J0013. These 10 color inks are pigmented inks respectively including ten color pigments as the color materials thereof.

Programs operated with an operating system of the host apparatus J0012 include an application and a printer driver. An application J0001 executes a process of generating image data with which the printing apparatus makes a print. Personal computers (PC) are capable of receiving these image data or pre-edited data which is yet to process by use of various medium. By means of a CF card, the host apparatus according to this embodiment is capable of populating, for example, JPEG-formatted image data associated with a photo taken with a digital camera. In addition, the host apparatus according to this embodiment is capable of populating, for example, TIFF-formatted image data read with a scanner and image data stored in a CD-ROM. Moreover, the host apparatus according to this embodiment is capable of capturing data from the Web through the Internet. These captured data are displayed on a monitor of the host apparatus. Thus, an edit, a process or the like is applied to these captured data by means of the application J0001. Thereby, image data R, G and B are generated, for example, in accordance with the sRGB specification. A user sets up a type of printing medium to be used for making a print, a printing quality and the like through a UI screen displayed on the monitor of the host apparatus. The user also issues a print instruction through the UI screen. Depending on this print instruction, the image data R, G and B are transferred to the printer driver.

The printer driver includes a precedent process J0002, a subsequent process J0003, a γ correction process J0004, a half-toning process J0005 and a print data creation process J0006 as processes performed by itself. Brief descriptions will be provided below for these processes J0002 to J0006.

(A) Precedent Process

The precedent process J0002 performs mapping of a gamut. In this embodiment, data are converted for the purpose of mapping the gamut reproduced by image data R, G and B in accordance with the sRGB specification onto a gamut to be produced by the printing apparatus. Specifically, a respective one of image data R, G and B deal with 256 gradations of the respective one of colors which are represented by 8 bits. These image data R, G and B are respectively converted to 8-bit data R, G and B in the gamut of the printing apparatus J0013 by use of a three-dimensional LUT.

(B) Subsequent Process

On the basis of the 8-bit data R, G and B obtained by mapping the gamut, the subsequent process J0003 obtains 8-bit color separation data on each of the 10 colors. The 8-bit color separation data correspond to a combination of inks which are used for reproducing a color represented by the 8-bit data R, G and B. In other words, the subsequent process J0003 obtains color separation data on each of Y, M, Lm, C, Lc, K1, K2, R, G, and Gray. In this embodiment, like the precedent process, the subsequent process is carried out by using the three dimensional LUT, simultaneously using an interpolating operation.

(C) γ Correction Process

The γ correction J0004 converts the color separation data on each of the 10 colors which have been obtained by the subsequent process J0003 to a tone value (gradation value) representing the color. Specifically, a one-dimensional LUT corresponding to the gradation characteristic of each of the color inks in the printing apparatus J0013 is used, and thereby a conversion is carried so that the color separation data on the 10 colors can be linearly associated with the gradation characteristics of the printer.

(D) Half-toning Process

The half-toning process J0005 quantizes the 8-bit color separation data on each of Y, M, Lm, C, Lc, K1, K2, R, G and Gray to which the γ correction process has been applied so as to convert the 8-bit separation data to 4-bit data. In this embodiment, the 8-bit data dealing with the 256 gradations of each of the 10 colors are converted to 4-bit data dealing with 9 gradations by use of the error diffusion method. The 4-bit data are data which serve as indices each for indicating a dot arrangement pattern in a dot arrangement patterning process in the printing apparatus.

(E) Print Data Creation Process

The last process performed by the printer driver is the print data creation process J0006. This process adds information on print control to data on an image to be printed whose contents are the 4-bit index data, and thus creates print data.

Figure 2:
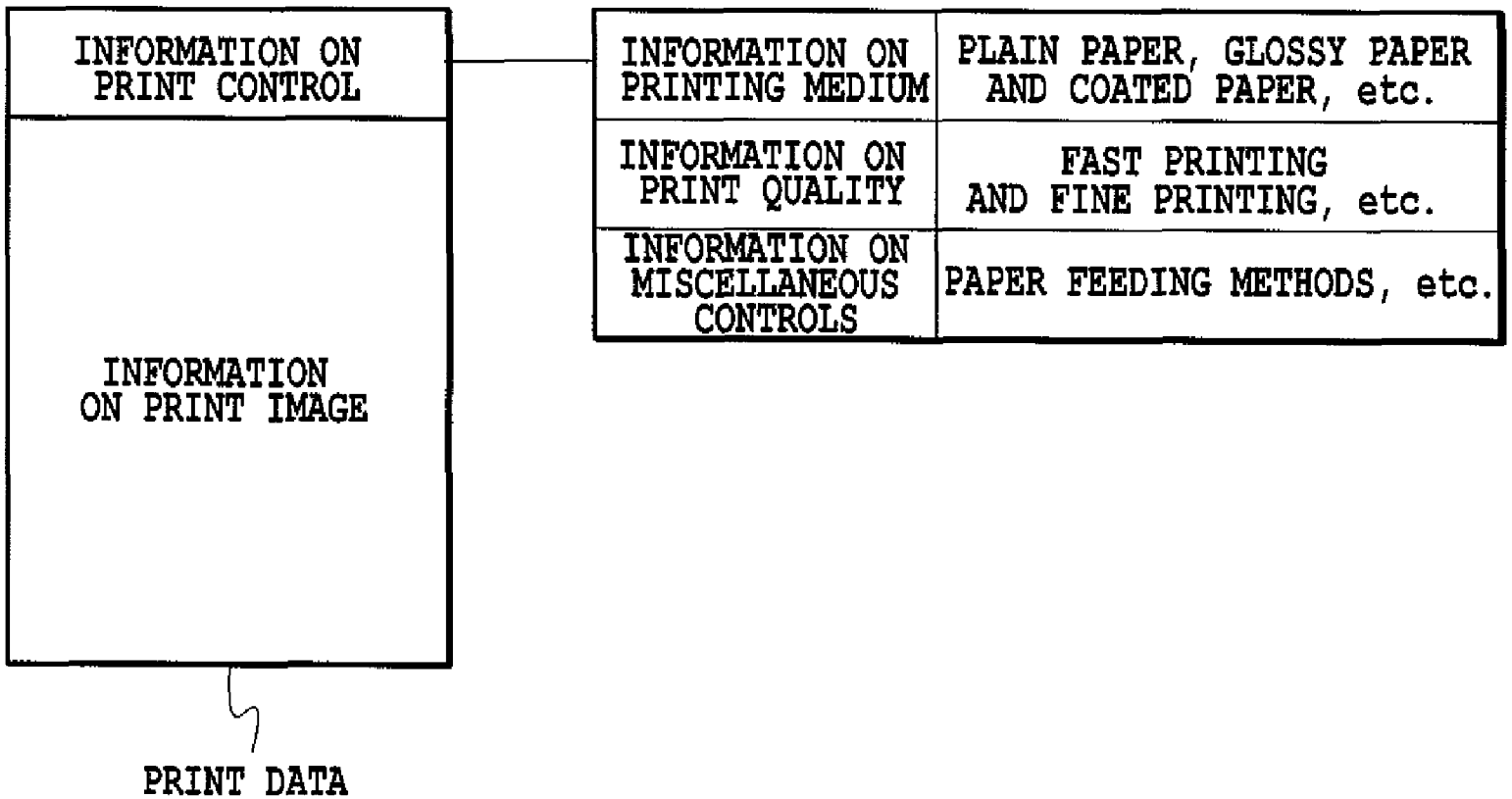
FIG. 2 is an explanatory diagram showing an example of a configuration of print data transferred from a printer driver of a host apparatus to a printing apparatus in the printing system shown in FIG. 1.

FIG. 2 is a diagram showing an example of a configuration of the print data. The print data are configured of the information on print control and the data on an image to be printed. The information on print control is in charge of controlling a printing operation. The data on an image to be printed indicates an image to be printed (the data are the foregoing 4-bit index data). The information on print control is configured of "information on printing medium," "information on print qualities," and "information on miscellaneous controls" including information on paper feeding methods or the like. Types of printing medium on which to make a print are described in the information on printing medium. One type of printing medium selected out of a group of plain paper, glossy paper, a post card, a printable disc and the like is specified in the information on printing medium. Print qualities to be sought are described in the information on print qualities. One type of print quality selected out of a group of "fine (high-quality print)," "normal," "fast (high-speed print)" and the like is specified in the information on print qualities. Note that these pieces of information on print control are formed on the basis of contents which a user designates through the UI screen in the monitor of the host apparatus J0012. In addition, image data originated in the half-toning process J0005 are described in the data on an image to be printed. The print data thus generated are supplied to the printing apparatus J0013.

The printing apparatus J0013 performs a dot arrangement patterning process J0007 and a mask data converting process J0008 on the print data which have been supplied from the host apparatus J0012. Descriptions will be provided next for the dot arrangement patterning process J0007 and the mask data converting process J0008.

(F) Dot Arrangement Patterning Process

In the above-described half-toning process J0005, the number of gradation levels is reduced from the 256 tone values dealt with by multi-valued tone information (8-bit data) to the 9 tone values dealt with by information (4-bit data). However, data with which the printing apparatus J0013 is actually capable of making a print are binary data (1-bit) data on whether or not an ink dot should be printed. Taken this into consideration, the dot arrangement patterning process J0007 assigns a dot arrangement pattern to each pixel represented by 4-bit data dealing with gradation levels 0 to 8 which are an outputted value from the half-toning process J0005. The dot arrangement pattern corresponds to the tone value (one of the levels 0 to 8) of the pixel. Thereby, whether or not an ink dot should be printed (whether a dot should be on or off) is defined for each of a plurality of areas in each pixel. Thus, 1-bit binary data indicating "1 (one)" or "0 (zero)" are assigned to each of the areas of the pixel. In this respect, "1 (one) " is binary data indicating that a dot should be printed. "0 (zero)" is binary data indicating that a dot should not be printed.

Figure 3:
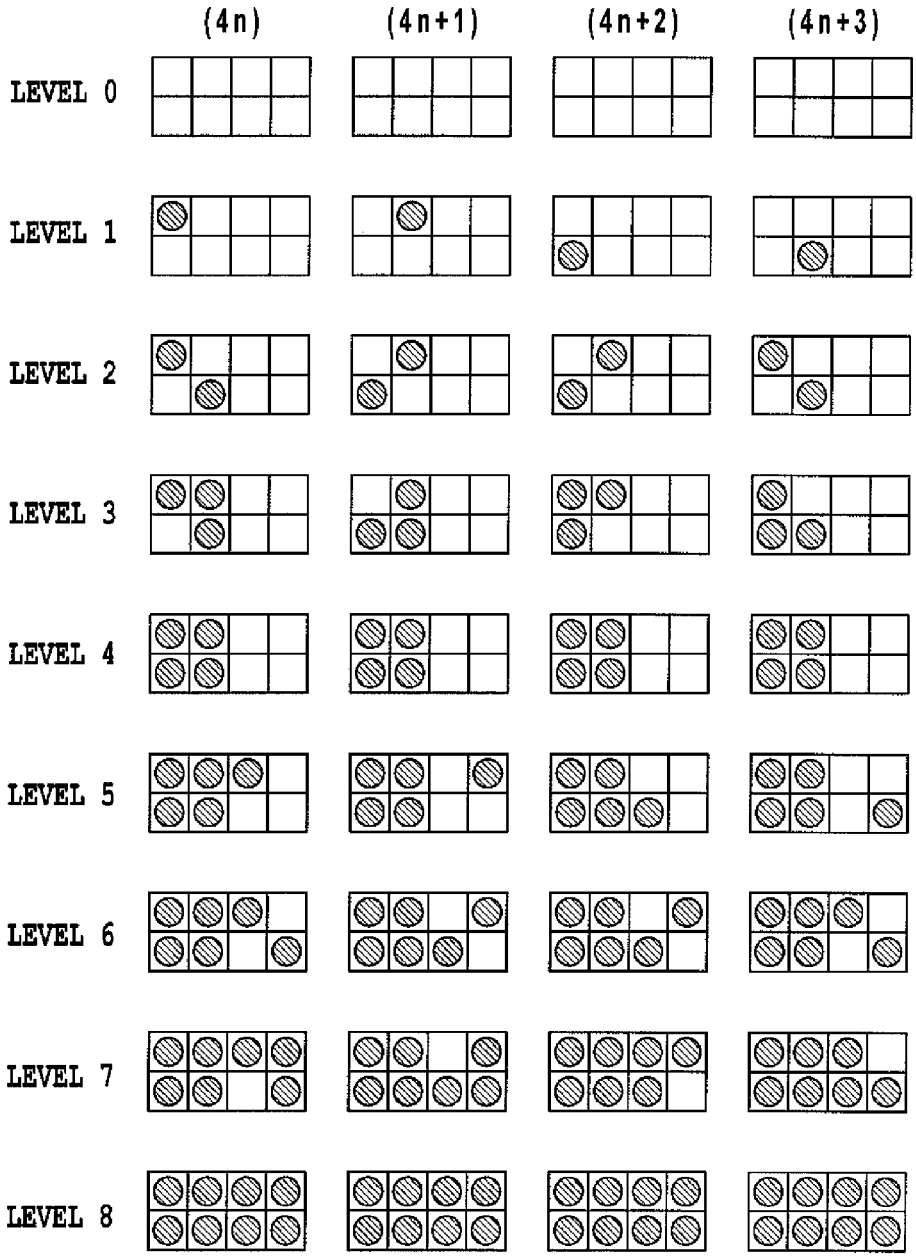
FIG. 3 is a diagram showing output patterns which correspond to input levels, and which are obtained by conversion in a dot arrangement patterning process in the printing apparatus used in the embodiment.

FIG. 3 shows output patterns corresponding to input levels 0 to 8. These output patterns are obtained through the conversion performed in the dot arrangement patterning process of the embodiment. Level numbers in the left column in the diagram correspond respectively to the levels 0 to 8 which are the outputted values from the half-toning process in the host apparatus. Regions each configured of 2 vertical areas×4 horizontal areas are shown to the right of this column. Each of the regions corresponds to a region occupied by one pixel receiving an output from the half-toning process. In addition, each of the areas in one pixel corresponds to a minimum unit for which it is specified whether the dot thereof should be on or off. Note that, in this description, a "pixel" means a minimum unit which is capable of representing a gradation, and also means a minimum unit to which the image processes (the precedent process, the subsequent process, the γ correction process, the half-toning process and the like) are applied using multi-valued data represented by the plurality of bits.

In this figure, an area in which a circle is drawn denotes an area where a dot is printed. As the level number increases, the number of dots to be printed increases one-by-one. In this embodiment, information on density of an original image is finally reflected in this manner.

From the left to the right, (4n) to (4n+3) denotes horizontal positions of pixels, each of which receives data on an image to be printed. An integer not smaller than 1 (one) is substituted for n in the expression (4n) to (4n+3). The patterns listed under the expression indicate that a plurality of mutually-different patterns are available depending on a position where a pixel is located even though the pixel receives an input at the same level. In other words, the configuration is that, even in a case where a pixel receives an input at one level, the four types of dot arrangement patterns under the expression (4n) to (4n+3) at the same level are assigned to the pixel in an alternating manner.

In FIG. 3, the vertical direction is a direction in which the ink ejection openings of the printing head are arrayed, and the horizontal direction is a direction in which the printing head moves. The configuration enabling a print to be made using the plurality of different dot arrangement patterns for one level brings about the following two effects. First, the number of times that ejection is performed can be equalized between two nozzles in which one nozzle is in charge of the patterns located in the upper row of the dot arrangement patterns at one level, and the other nozzle is in charge of the patterns located in the lower row of the dot arrangement patterns at the same level. Secondly, various noises unique to the printing apparatus can be desegregated.

When the above-described dot arrangement patterning process is completed, the assignment of dot arrangement patterns to the entire printing medium is completed.

(G) Mask Data Converting Process

In the foregoing dot arrangement patterning process J0007, whether or not a dot should be printed is determined for each of the areas on the printing medium. As a result, if binary data indicating the dot arrangement are inputted to a drive circuit J0009 of the printing head H1001, a desired image can be printed. In this case, what is termed as a one-pass print can be made. The one-pass print means that a print to be made for a single scan region on a printing medium is completed by the printing head H1001 moving once. Alternatively, what is termed as a multi-pass print can be made. The multi-pass print means that a print to be made for a single scan region on the printing medium is completed by the printing head moving a plurality of times. Here, descriptions will be provided for a mask data converting process, taking an example of the multi-pass print.

Figure 4:
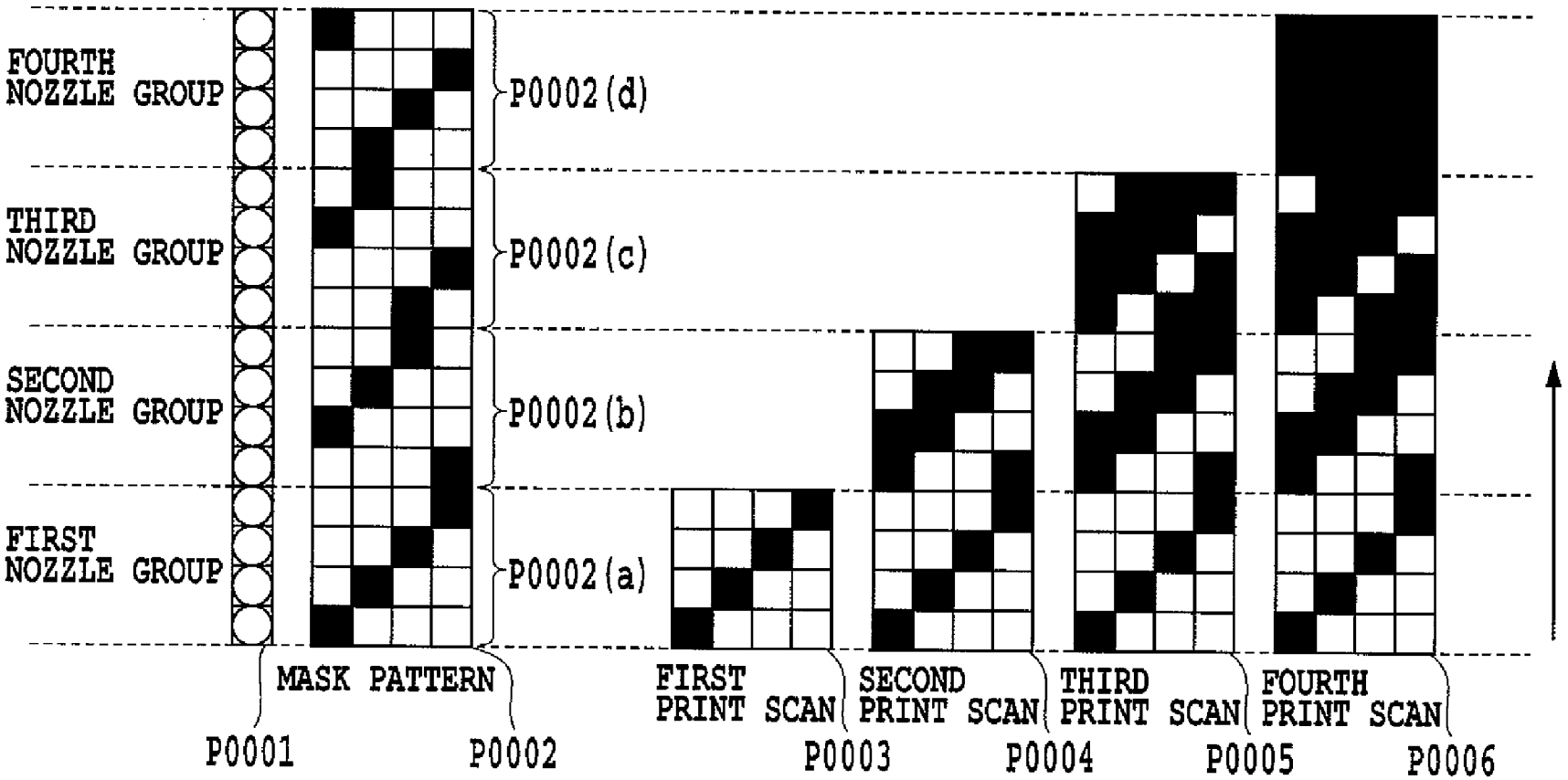
FIG. 4 is a schematic diagram for explaining a multi-pass printing method which is performed by the printing apparatus used in the embodiment.

FIG. 4 is a schematic diagram showing the printing head and print patterns for the purpose of describing the multi-pass printing method. The print head H1001 applied to this embodiment actually has 768 nozzles. For the sake of convenience, however, descriptions will be provided for the printing head and the print patterns, supposing that the printing head H1001 has 16 nozzles. The nozzles are divided into a first to a fourth nozzle groups. Each of the four nozzle groups includes four nozzles. Mask P0002 are configured of a first to a fourth mask patterns P0002(*a*) to P0002(*d*). The first to the fourth mask patterns P0002(*a*) to P0002(*d*) define the respective areas in which the first to the fourth nozzle groups are capable of making a print. Blackened areas in the mask patterns indicate printable areas, whereas whitened areas in the mask patterns indicate unprinted areas. The first to the fourth mask patterns are complementary to one another. The configuration is that, when these four mask patterns are superposed over one another, a print to be made in a region corresponding to a 4×4 area is completed.

Patterns denoted by reference numerals P0003 to P0006 show how an image is going to be completed by repeating a print scan. Each time a print scan is completed, the printing medium is transferred by a width of the nozzle group (a width of four nozzles in this figure) in a direction indicated by an arrow in the figure. In other words, the configuration is that an image in any same region (a region corresponding to the width of each nozzle region) on the printing medium is completed by repeating the print scan four times. Formation of an image in any same region on the printing medium by use of multiple nozzle groups by repeating the scan the plurality of times in the afore-mentioned manner makes it possible to bring about an effect of reducing variations characteristic of the nozzles, and an effect of reducing variations in accuracy in transferring the printing medium.

Figure 5:
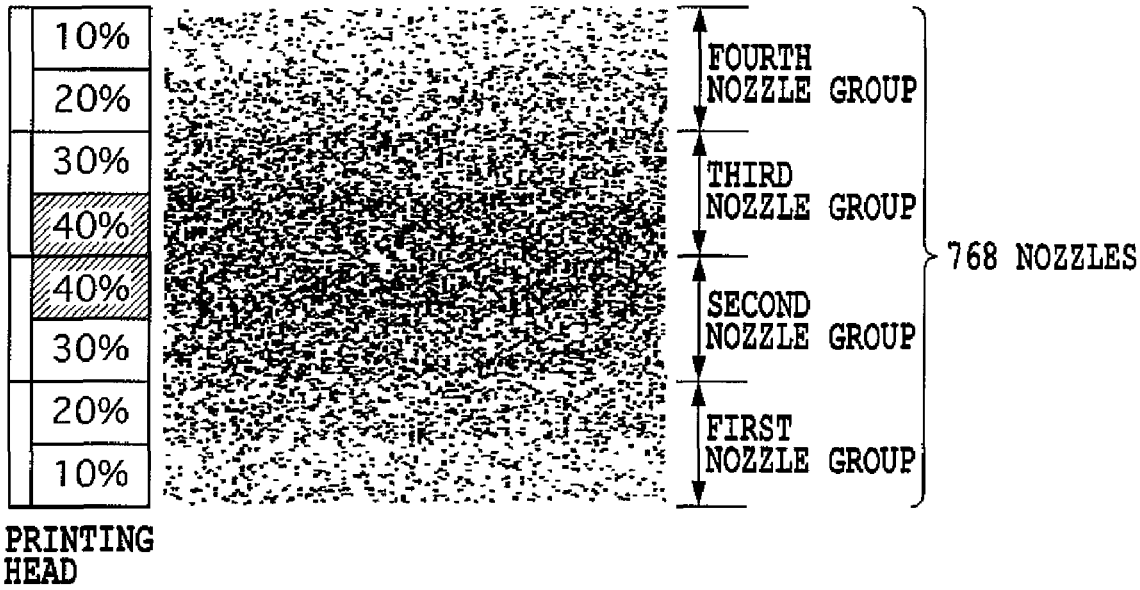
FIG. 5 is an explanatory diagram showing an example of mask patterns which are applied to the multi-pass printing method which is performed by the printing apparatus used in the embodiment.

FIG. 5 shows an example of mask which is capable of being actually applied to this embodiment. The printing head H1001 to which this embodiment is applied has 768 nozzles, and 192 nozzles belong to each of the four nozzle groups. As for the size of the mask, the mask has 768 areas in the vertical direction, and this number is equal to the number of nozzles. The mask has 256 areas in the horizontal direction. The mask has a configuration that the four mask patterns respectively corresponding to the four nozzle groups maintain a complementary relationship among themselves.

In the case of the ink jet printing head applied to this embodiment, which ejects a large number of fine ink droplets by means of a high frequency, it has been known that an air flow occurs in a neighborhood of the printing part during printing operation. In addition, it has been proven that this air flow particularly affects a direction in which ink droplets are ejected from nozzles located in the end portions of the printing head. For this reason, in the case of the mask patterns of this embodiment, a distribution of printable ratios is biased depending on which nozzle group a region belongs to, and on where a region is located in each of the nozzle groups, as seen from FIG. 5. As shown in FIG. 5, by employing the mask patterns having a configuration which makes the printable ratios of the nozzles in the end portions of the printing head smaller than those of nozzles in a central portion thereof, it is possible to make inconspicuous an adverse effect stemming from variations in positions where ink droplets ejected from the nozzles in the end portions of the printing head are landed.

Note that a printable ratio specified by a mask pattern is as follows. A printable ratio of a mask pattern is a percentage denomination of a ratio of the number of printable areas constituting the mask pattern (blackened areas in the mask pattern P0002(*a*) to P0002(*d*) of FIG. 4) to the sum of the number of printable areas and the number of unprintable areas constituting the mask pattern (the whitened areas in the mask patterns P0002(*a*) to P0002(*d*) of FIG. 4). In other words, a printable ratio (%) of a mask pattern is expressed by $$M\div(M+N)\times 100$$

where M denotes the number of printable areas constituting the mask pattern and N denotes the number of unprintable areas constituting the mask pattern.

In this embodiment, data for the mask as shown in FIG. 5 are stored in memory in the main body of the printing apparatus. The mask data converting process J0008 performs the AND process on the mask data with the binary data obtained in the foregoing dot arrangement patterning process. Thereby, binary data to be a print object in each print scan are determined. Subsequently, the binary data are transferred to the driving circuit J0009. Thus, the printing head H1001 is driven, and hence inks are ejected in accordance with the binary data.

FIG. 1 shows that the host apparatus J0012 is configured to perform the precedent process J0002, the subsequent process J0003, the γ correction process J0004, the half-toning process J0005 and the print data creation process J0006. In addition, FIG. 1 shows that the printing apparatus J0013 is designed to perform the dot arrangement patterning process J0007 and the mask data converting process J0008. However, the present invention is not limited to this embodiment. For example, the present invention may be carried out as an embodiment in which parts of the processes J0002 to J0005 are designed to be performed by the printing apparatus J0013 instead of by the host apparatus J0012. Otherwise, the present invention may be carried out as an embodiment in which all of these processes are designed to be performed by the host apparatus J0012. Alternately, the present invention may be carried out as an embodiment in which the processes J0002 to J0008 are designed to be performed by the printing apparatus J0013.

2. Mechanical Part Construction

Now explanation will be made on the construction of a mechanical part of a printing apparatus to be applied in the present embodiment. The printing apparatus used in the embodiment is arranged with a plurality of ink ejection openings so that an image can be printed on a printing medium by performing a relative movement of the printing medium and the printing head having a plurality of ejection-opening arrays in a direction intersecting with the arrangement direction of the ejection openings. The printing apparatus body in the embodiment is classified as a paper feeding section, a paper conveying section, a paper discharging section, a carriage, a cleaning section, an outer case, a flat-pass section and a wetting-liquid transferring unit, in respect of the role of each mechanism. In the following, those will be outlined on an item-by-item basis.

(A) Paper Feeding Section

Figure 6:
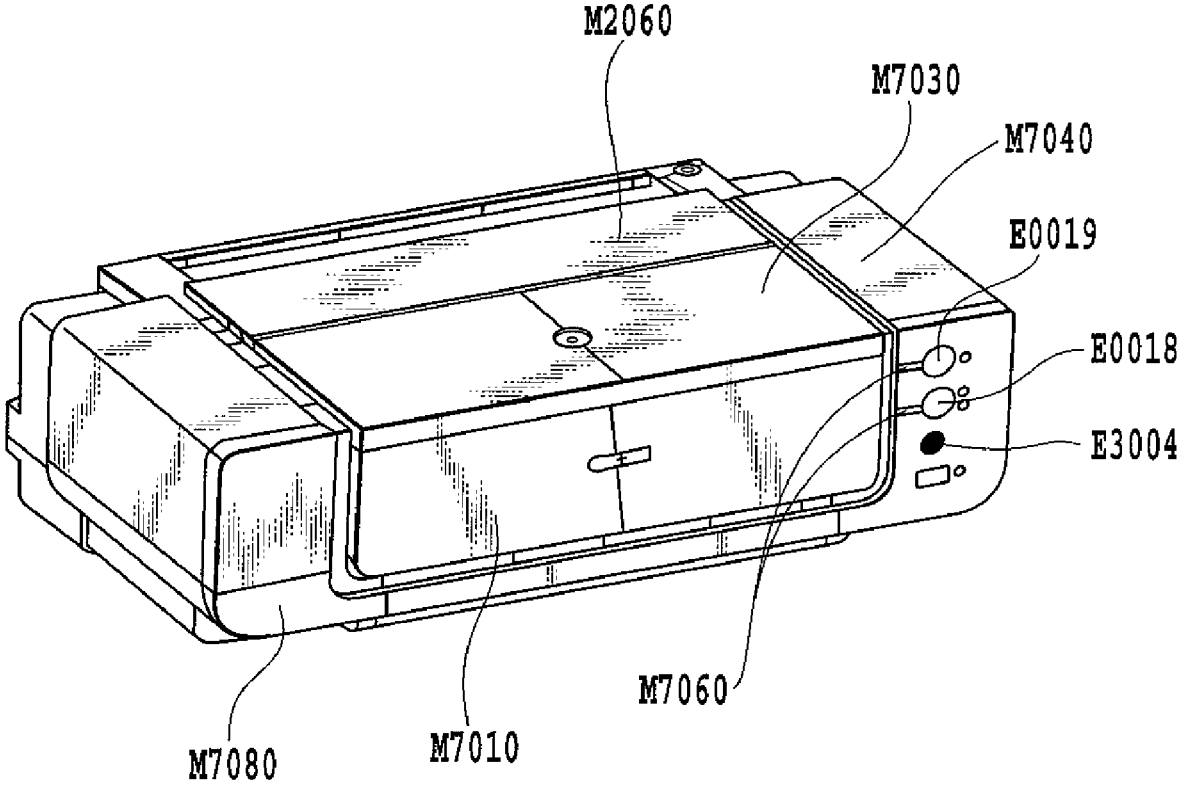
FIG. 6 is a perspective view of the printing apparatus used in the embodiment, and shows the printing apparatus in an unused condition when viewed from the front.
Figure 7:
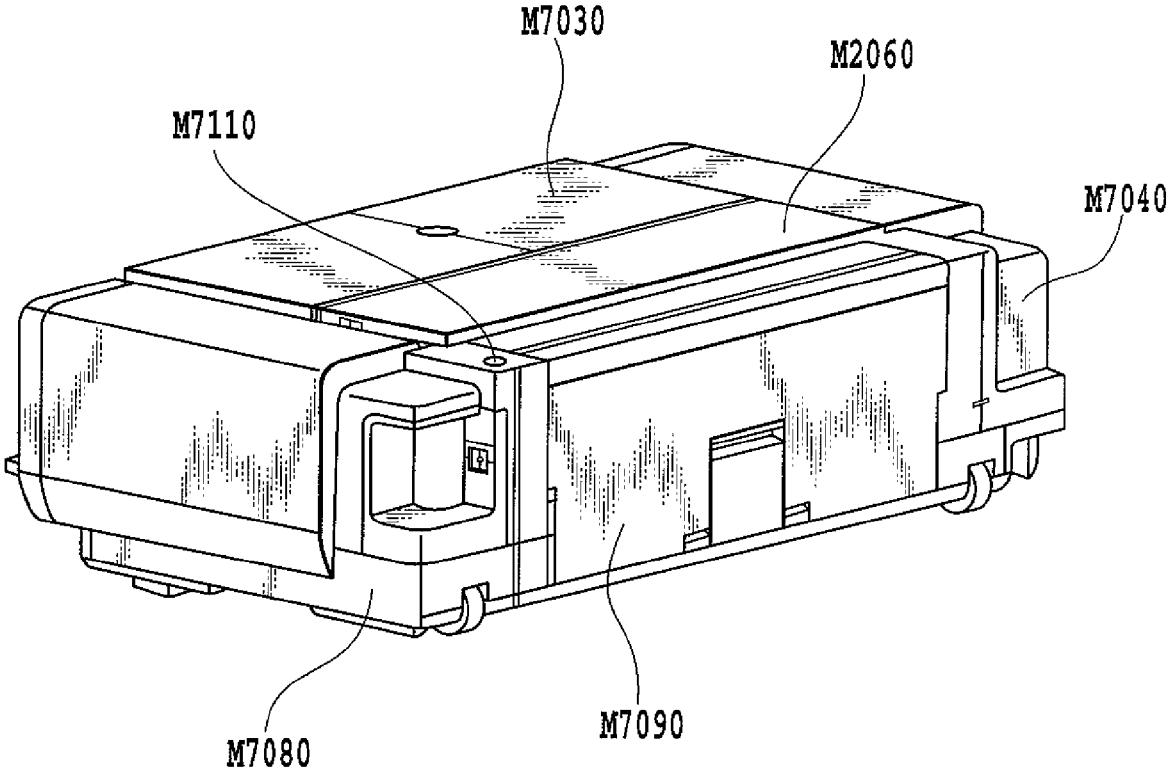
FIG. 7 is another perspective view of the printing apparatus used in the embodiment, and shows the printing apparatus in the unused condition when viewed from the back.
Figure 8:
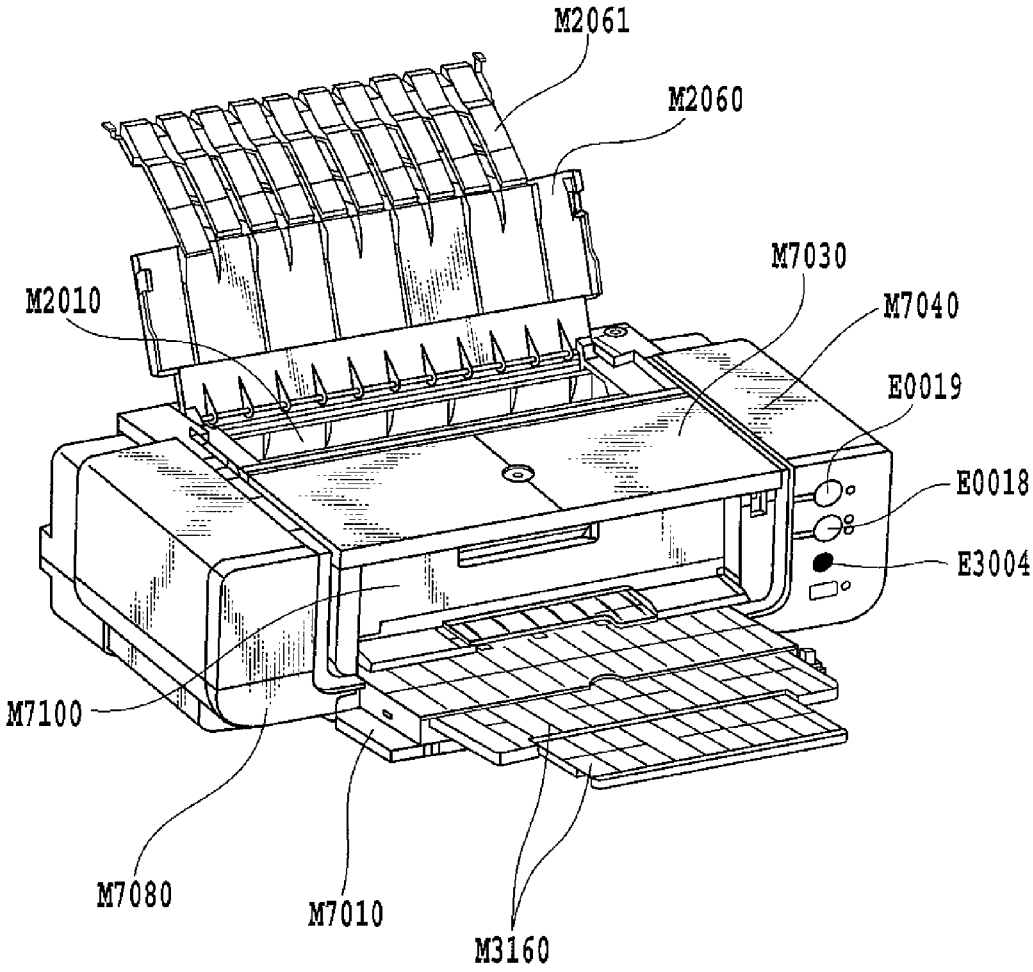
FIG. 8 is yet another perspective view of the printing apparatus used in the embodiment, and shows the printing apparatus in a used condition when viewed from the front.
Figure 9:
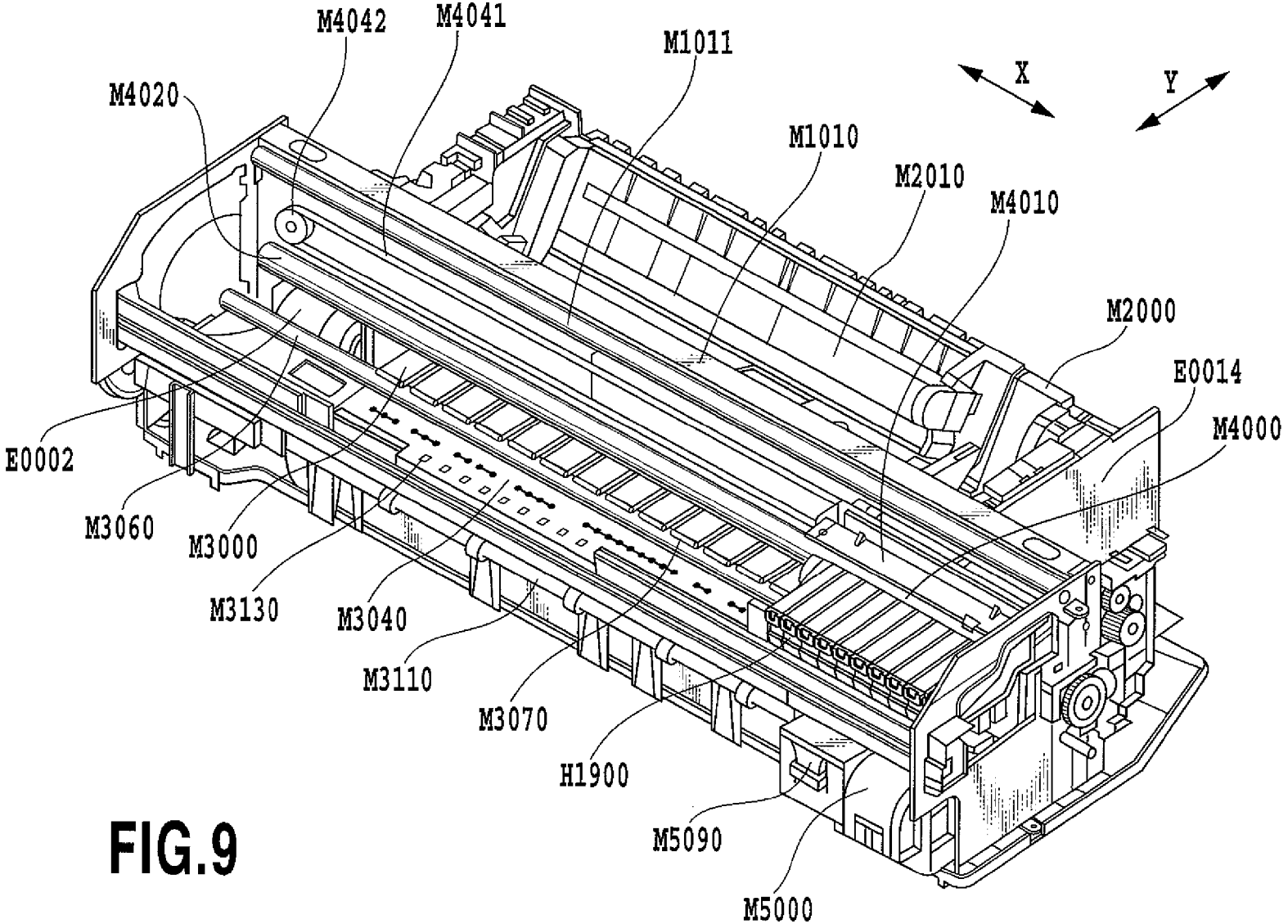
FIG. 9 is a diagram for explaining an internal mechanism of the main body of the printing apparatus used in the embodiment, and is a perspective view showing the printing apparatus when viewed from the right above.
Figure 10:
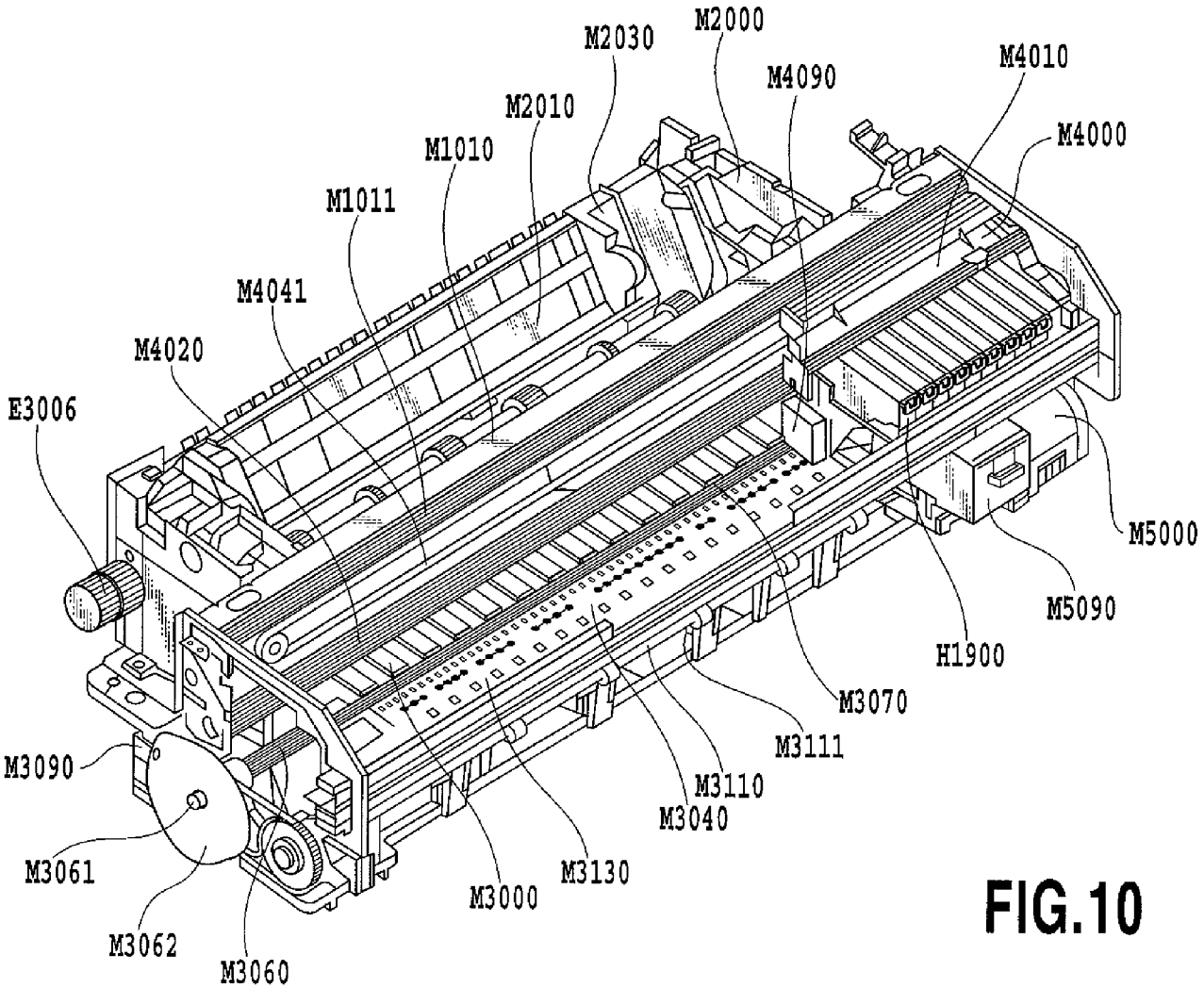
FIG. 10 is another diagram for explaining the internal mechanism of the main body of the printing apparatus used in the embodiment, and is another perspective view showing the printing apparatus when viewed from the left above.
Figure 11:
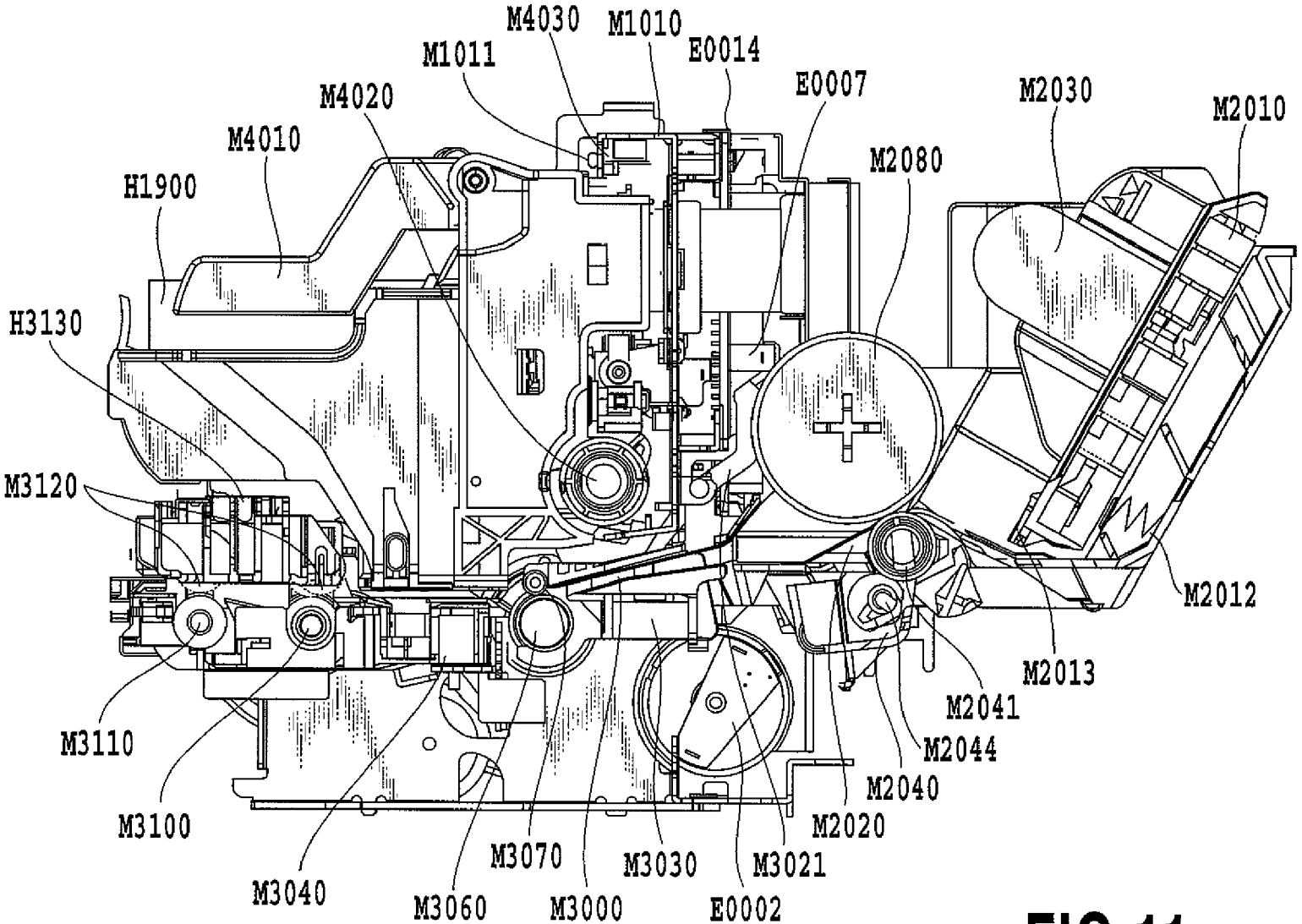
FIG. 11 is a side, cross-sectional view of the main body of the printing apparatus used in the embodiment for the purpose of explaining the internal mechanism of the main body of the printing apparatus.
Figure 12:
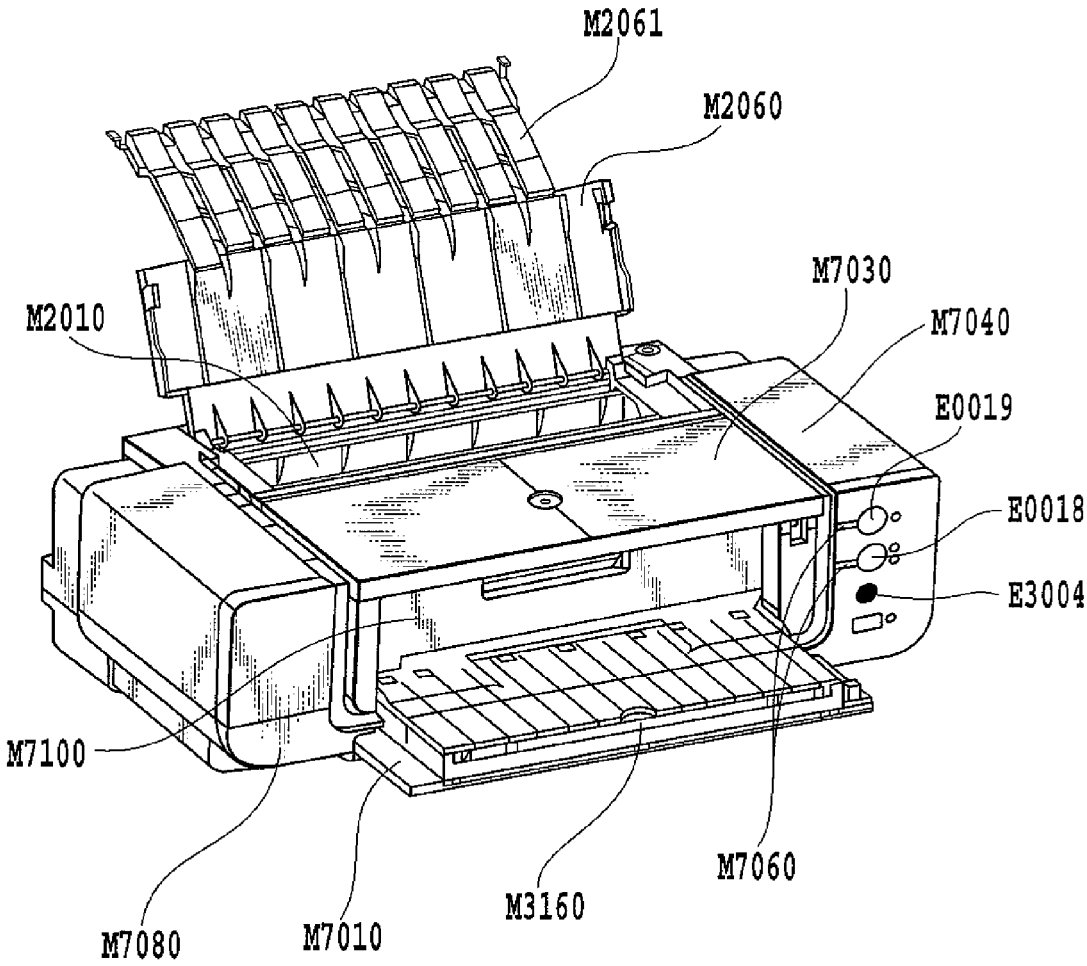
FIG. 12 is yet another perspective view of the printing apparatus used in the embodiment, and shows the printing apparatus in the process of performing a flat-pass printing operation when viewed from the front.
Figure 13:
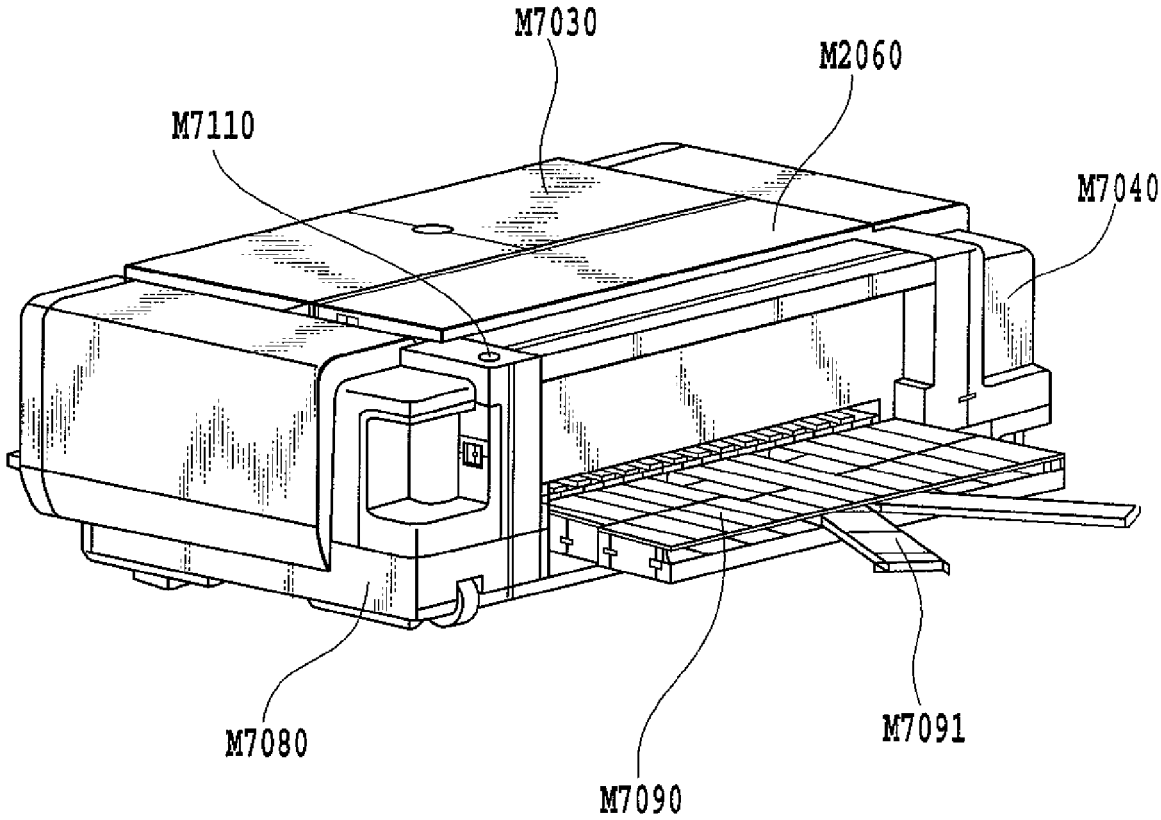
FIG. 13 is still another perspective view of the printing apparatus used in the embodiment, and shows the printing apparatus in the process of performing the flat-pass printing operation when viewed from the back.
Figure 14:
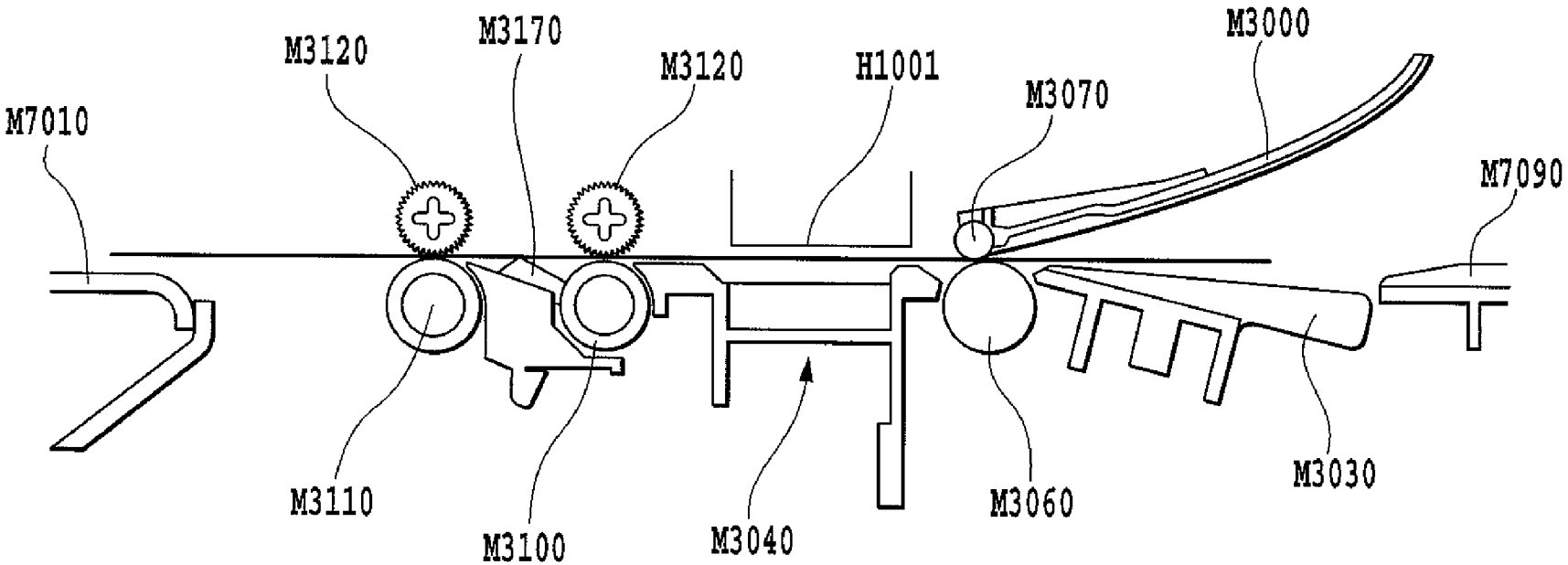
FIG. 14 is a schematic, side, cross-sectional view of the internal mechanism for explaining the flat-pass printing operation performed in the embodiment.
Figure 15:
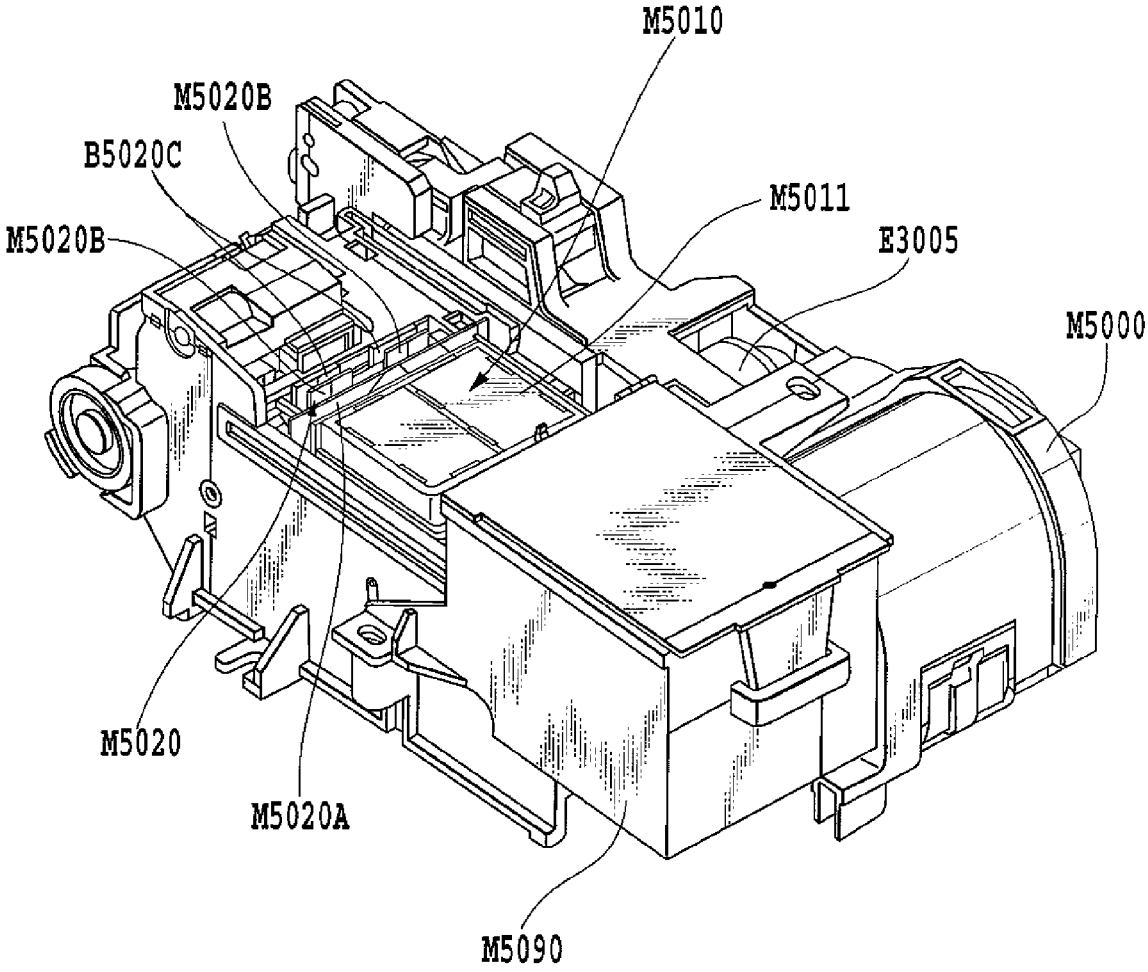
FIG. 15 is a perspective view showing a cleaning section in the main body of the printing apparatus used in the embodiment.
Figure 16:
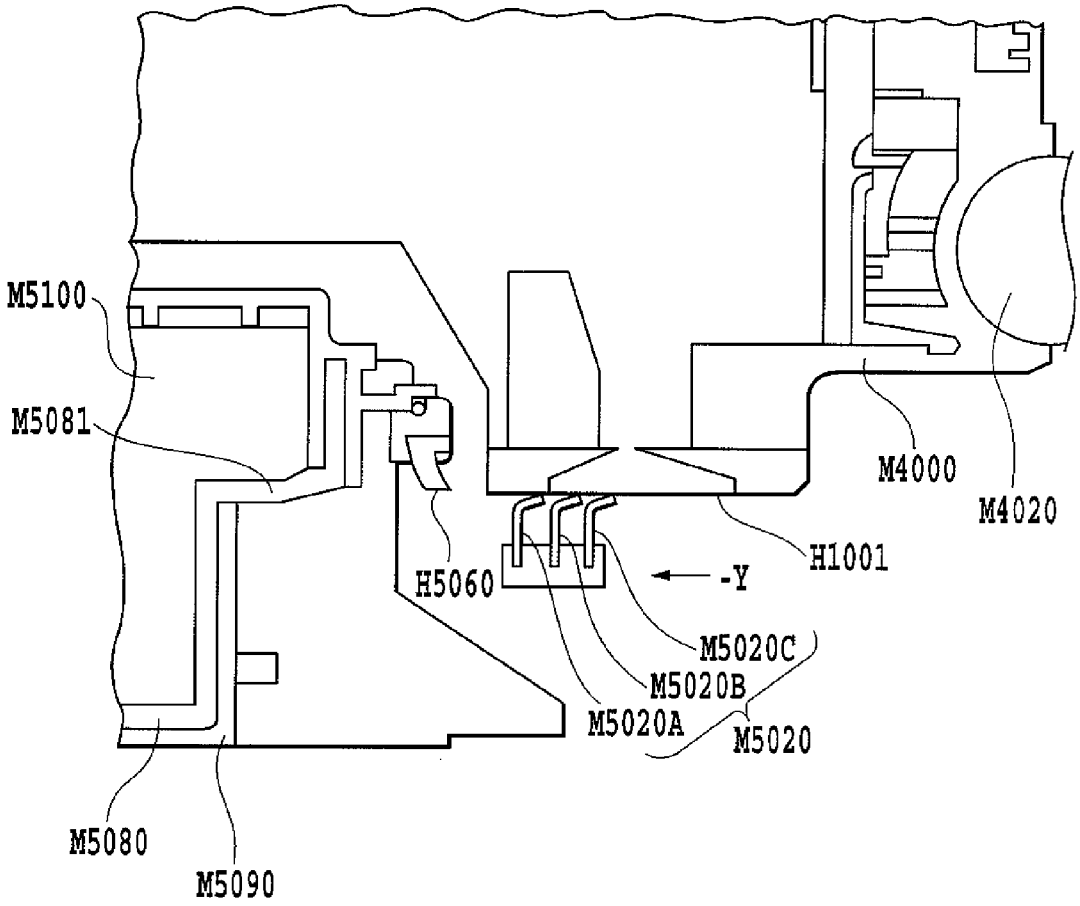
FIG. 16 is a cross-sectional view of a wiper portion in the cleaning section shown in FIG. 15 for explaining a configuration and an operation of the wiper portion.
Figure 17:
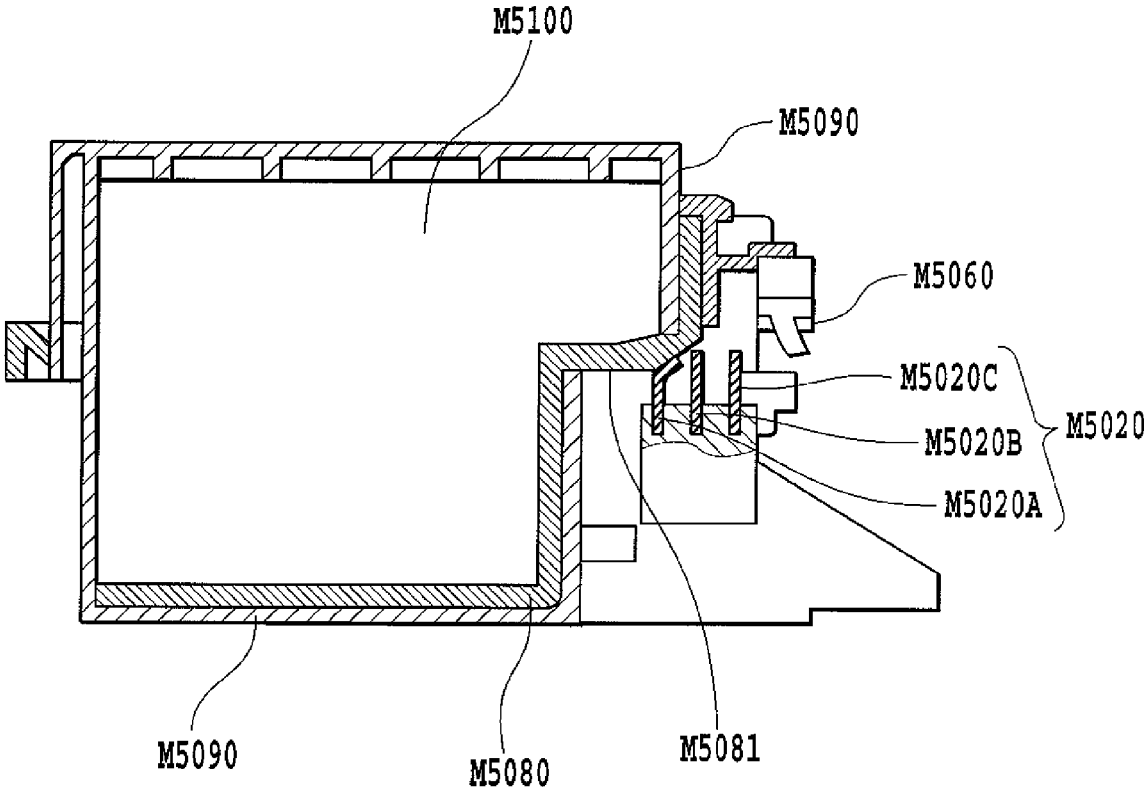
FIG. 17 is a cross-sectional view of a wetting liquid transferring unit in the cleaning section for explaining a configuration and an operation of the wetting liquid transferring unit.

FIGS. 6, 7, 8, 12 and 13 are perspective views respectively showing appearances of the printing apparatus to which this embodiment is applied. FIG. 6 shows the printing apparatus in an unused condition when viewed from the front. FIG. 7 shows the printing apparatus in an unused condition when viewed from the back. FIG. 8 shows the printing apparatus in a used condition when viewed from the front. FIG. 12 shows the printing apparatus during flat-pass printing when viewed from the front. FIG. 13 shows the printing apparatus during flat-pass printing when viewed from the back. In addition, FIGS. 9 to 11 and 14 to 16 are diagrams for describing internal mechanisms in the main body of the printing apparatus. In this respect, FIG. 9 is a perspective view showing the printing apparatus when viewed from the right above. FIG. 10 is a perspective view showing the printing apparatus when viewed from the left above. FIG. 11 is a side, cross-sectional view of the main body of the printing apparatus. FIG. 14 is a cross-sectional view of the printing apparatus during flat-pass printing. FIG. 15 is a perspective view of the cleaning section. FIG. 16 is a cross-sectional view for describing a configuration and an operation of a wiping mechanism in the cleaning section. FIG. 17 is a cross-sectional view of a wetting liquid transferring unit in the cleaning section.

The paper feeding section is structured with a press plate 2010 for stacking printing medium thereon, a paper feeding roller M2080 for supplying a printing medium sheet by sheet, a separation roller M2041 for separating a printing medium, a return lever M2020 for bringing the printing medium to the stack position and so on, which are arranged on a base M2000.

(B) Paper Conveying Section

A conveying roller M3060 for conveying a printing medium is rotatably attached to a chassis M1010 made of an upwardly bent plate. The conveying roller M3060 has a configuration in which the surface of a metal shaft is coated with ceramic fine particles. The conveying roller M3060 is attached to the chassis M1010 in a state in which metallic parts respectively of the two ends of the shaft are received by bearings (not illustrated). The conveying roller M3060 is provided with a roller tension spring (not illustrated). The roller tension spring pushes the conveying roller M3060, and thereby applies an appropriate amount of load to the conveying roller M3060 while the conveying roller M3060 is rotating. Accordingly, the conveying roller M3060 is capable of conveying printing medium stably.

The conveying roller M3060 is provided with a plurality of pinch rollers M3070 in a way that the plurality of pinch rollers M3070 abut on the conveying roller M3060. The plurality of pinch rollers M3070 are driven by the conveying roller M3060. The pinch rollers M3070 are held by a pinch roller holder M3000. The pinch rollers M3070 are pushed respectively by pinch roller springs (not illustrated), and thus are brought into contact with the conveying roller M3060 with the pressure. This generates a force for conveying printing medium. At this time, since the rotation shaft of the pinch roller holder M3000 is attached to the bearings of the chassis M1010, the rotation shaft rotates thereabout.

A paper guide flapper M3030 and a platen M3040 are disposed in an inlet to which a printing medium is conveyed. The paper guide flapper M3030 and the platen M3040 guide the printing medium. In addition, the pinch roller holder M3000 is provided with a PE sensor lever M3021. The PE sensor lever M3021 transmits a result of detecting the front end or the rear end of each of the printing medium to a paper end sensor (hereinafter referred to as a "PE sensor") E0007 fixed to the chassis M1010. The platen M3040 is attached to the chassis M1010, and is positioned thereto. The paper guide flapper M3030 is capable of rotating about a bearing unit (not illustrated), and is positioned to the chassis M1010 by abutting on the chassis M1010.

The printing head H1001 (refer to FIG. 21) is provided at a side downstream in a direction in which the conveying roller M3060 conveys the printing medium.

Descriptions will be provided for a process of conveying printing medium in the printing apparatus with the foregoing configuration. A printing medium sent to the paper conveying section is guided by the pinch roller holder M3000 and the paper guide flapper M3030, and thus is sent to a pair of rollers which are the conveying roller 3060 and the pinch roller M3070. At this time, the PE sensor lever M3021 detects an edge of the printing medium. Thereby, a position in which a print is made on the printing medium is obtained. The pair of rollers which are the conveying roller M3060 and the pinch roller M3070 are driven by an LF motor E0002, and are rotated. This rotation causes the printing medium to be conveyed over the platen M3040. A rib is formed in the platen M3040, and the rib serves as a conveyance datum surface. A gap between the printing head H1001 and the surface of the printing medium is controlled by this rib. Simultaneously, the rib also suppresses flapping of the printing medium in cooperation with the paper discharging section which will be described later.

A driving force with which the conveying roller M3060 rotates is obtained by transmitting a torque of the LF motor E0002 consisting, for example, of a DC motor to a pulley M3061 disposed on the shaft of the conveying roller M3060 through a timing belt (not illustrated). A code wheel M3062 for detecting an amount of conveyance performed by the conveying roller M3060 is provided on the shaft of the conveying roller M3060. In addition, an encode sensor M3090 for reading a marking formed in the code wheel M3062 is disposed in the chassis M1010 adjacent to the code wheel M3062. Incidentally, the marking formed in the code wheel M3062 is assumed to be formed at a pitch of 150 to 300 lpi (line/inch) (an example value).

(C) Paper Discharging Section

The paper discharging section is configured of a first paper discharging roller M3100, a second paper discharging roller M3110, a plurality of spurs M3120 and a gear train.

The first paper discharging roller M3100 is configured of a plurality of rubber portions provided around the metal shaft thereof. The first paper discharging roller M3100 is driven by transmitting the driving force of the conveying roller M3060 to the first paper discharging roller M3100 through an idler gear.

The second paper discharging roller M3110 is configured of a plurality of elastic elements M3111, which are made of elastomer, attached to the resin-made shaft thereof. The second paper discharging roller M3110 is driven by transmitting the driving force of the first paper discharging roller M3100 to the second paper discharging roller M3110 through an idler gear.

Each of the spurs M3120 is formed by integrating a circular thin plate and a resin part into one unit. A plurality of convex portions are provided to the circumference of each of the spurs M3120. Each of the spurs M3120 is made, for example, of SUS. The plurality of spurs M3120 are attached to a spur holder M3130. This attachment is performed by use of a spur spring obtained by forming a coiled spring in the form of a stick. Simultaneously, a spring force of the spur spring causes the spurs M3120 to abut respectively on the paper discharging rollers M3100 and M3110 at predetermined pressures. This configuration enables the spurs 3120 to rotate to follow the two paper discharging rollers M3100 and M3110. Some of the spurs M3120 are provided at the same positions as corresponding ones of the rubber portions of the first paper discharging roller M3110 are disposed, or at the same positions as corresponding ones of the elastic elements M3111 are disposed. These spurs chiefly generates a force for conveying printing medium. In addition, others of the spurs M3120 are provided at positions where none of the rubber portions and the elastic elements M3111 is provided. These spurs M3120 chiefly suppresses lift of a printing medium while a print is being made on the printing medium.

Furthermore, the gear train transmits the driving force of the conveying roller M3060 to the paper discharging rollers M3100 and M3110.

A paper-end support, not shown, is provided between a first paper-discharging roller M3100 and a second paper-discharging roller M3110. The paper-end support is to play a role to protect a print, made on the printing medium, from being scratched by the carriage, by lifting the both ends of the printing medium and supporting the printing medium on the first paper-discharging roller M3100. Specifically, a resin member having a roll, not shown, at the tip thereof is biased by a paper-end support spring M3152, not shown, to push a roll M3151 at a predetermined pressure on the printing medium. This can lift the printing medium at its both ends and hold it in a predetermined position with elasticity.

With the foregoing configuration, a printing medium on which an image is formed is pinched with nips between the first paper discharging roller M3110 and the spurs M3120, and thus is conveyed. Accordingly, the printing medium is delivered to the paper discharging tray M3160. The paper discharging tray M3160 is divided into a plurality of parts, and has a configuration in which the paper discharging tray M3160 is capable of being contained under the lower case M7080 which will be described later. When used, the paper discharging tray M3160 is drawn out from under the lower case M7080. In addition, the paper discharging tray M3160 is designed to be elevated toward the front end thereof, and is also designed so that the two side ends thereof are held at a higher position. The design enhances the stackability of printing medium, and prevents the printing surface of each of the printing medium from being rubbed (Refer to FIG. 7).

(D) Carriage Section

The carriage section includes a carriage M4000 to which the printing head H1001 is attached. The carriage M4000 is supported with a guide shaft M4020 and a guide rail M1011. The guide shaft M4020 is attached to the chassis M1010, and guides and supports the carriage M4000 so as to cause the carriage M4000 to perform reciprocating scan in a direction perpendicular to a direction in which a printing medium is conveyed. The guide rail M1011 is formed in a way that the guide rail M1011 and the chassis M1010 are integrated into one unit. The guide rail M1011 holds the rear end of the carriage M4000, and thus maintains the space between the printing head H1001 and the printing medium. A slide sheet M4030 formed of a thin plate made of stainless steel or the like is stretched on a side of the guide rail M1011, on which side the carriage M4000 slides. This makes it possible to reduce sliding noises of the printing apparatus.

The carriage M4000 is driven by a carriage motor E0001 through a timing belt M4041. The carriage motor E0001 is attached to the chassis M1010. In addition, the timing belt M4041 is stretched and supported by an idle pulley M4042. Furthermore, the timing belt M4041 is connected to the carriage M4000 through a carriage damper made of rubber. Thus, image unevenness is reduced by damping the vibration of the carriage motor E0001 and the like.

An encoder scale E0005 for detecting the position of the carriage M4000 is provided in parallel with the timing belt M4041 (the encoder scale E0005 will be described later by referring to FIG. 18). Markings are formed on the encoder scale E0005 at pitches in a range of 150 lpi to 300 lpi. An encoder sensor E0004 for reading the markings is provided on a carriage board E0013 installed in the carriage M4000 (the encoder sensor E0004 and the carriage board E0013 will be described later by referring to FIG. 18). A head contact E0101 for electrically connecting the carriage board E0013 to the printing head H1001 is also provided to the carriage board E0013. Moreover, a flexible cable E0012 (not illustrated) is connected to the carriage M4000 (the flexible cable E0012 will be described later by referring to FIG. 18). The flexible cable E0012 is that through which a drive signal is transmitted from an electric substrate E0014 to the printing head H1001.

As for components for fixing the printing head H1001 to the carriage M4000, the following components are provided to the carriage M4000. An abutting part (not illustrated) and pressing means (not illustrated) are provided on the carriage M4000. The abutting part is with which the printing head H1001 positioned to the carriage M4000 while pushing the printing head H1001 against the carriage M4000. The pressing means is with which the printing head H1001 is fixed at a predetermined position. The pressing means is mounted on a headset lever M4010. The pressing means is configured to act on the printing head H1001 when the headset lever M4010 is turned about the rotation support thereof in a case where the printing head H1001 is intended to be set up.

Moreover, a position detection sensor M4090 including a reflection-type optical sensor is attached to the carriage M4000. The position detection sensor is used while a print is being made on a special medium such as a CD-R, or when a print result or the position of an edge of a sheet of paper is being detected. The position detection sensor M4090 is capable of detecting the current position of the carriage M4000 by causing a light emitting device to emit light and by thus receiving the emitted light after reflecting off the carriage M4000.

In a case where an image is formed on a printing medium in the printing apparatus, the set of the conveying roller M3060 and the pinch rollers M3070 transfers the printing medium, and thereby the printing medium is positioned in terms of a position in a column direction. In terms of a position in a row direction, by using the carriage motor E0001 to move the carriage M4000 in a direction perpendicular to the direction in which the printing medium is conveyed, the printing head H1001 is located at a target position where an image is formed. The printing head H1001 thus positioned ejects inks onto the printing medium in accordance with a signal transmitted from the electric substrate E0014. Descriptions will be provided later for details of the configuration of the printing head H1001 and a printing system. The printing apparatus of this embodiment alternately repeats a printing main scan and a sub-scan. During the printing main scan, the carriage M4000 scans in the row direction while the printing head H1001 is making a print. During the sub-scan, the printing medium is conveyed in the column direction by conveying roller M3060. Thereby, the printing apparatus is configured to form an image on the printing medium.

(E) Cleaning Section

The cleaning section is structured with a pump M5000, a cap M5010, a wiper M5020 and so on. The pump M5000 is for cleaning the printing head H1001. The cap M5010 is a cap for suppressing the printing head H1001 from drying. The wiper M5020 is provided to clean an ejection-opening formed surface of the printing head H1001.

In the cleaning section, an exclusive cleaning motor E0003 is arranged. The cleaning motor E0003 is provided with a one-way clutch, not shown, so that rotating it in one direction can cause the pump to operate and rotating it in the other direction can cause the wiper M5020 to operate simultaneously with rising/lowering the cap M5010.

The pump M5000 is structured to generate a negative pressure by squeezing two tubes, not shown, by means of a pump roll, not shown. Meanwhile, the cap M5010 is connected to the pump M5000 through a valve, not shown, and the like. By operating the pump M5000 in a state the cap M5010 is put closely over the ink ejection openings of the printing head H1001, unwanted ink, etc. is to be drawn out of the printing head H1001. Furthermore, at the inside of the cap M5010, an in-cap absorber M5011 is provided in order to reduce the ink remaining on a face surface of the post-suction head M6000. Meanwhile, consideration is given not to cause an adhesion of the remaining ink and the resulting failure by drawing the ink left in the cap M5010 in a state the cap M5010 is opened. The ink, drawn by the pump M5000, becomes a waste ink to be absorbed and held in a waste ink absorber M7090 provided in a lower case M7080.

A series of successive operations, e.g. operation of the wiper M5020, rising/lowering of the cap M5010 and opening/closing of the valve M5050, are controlled by a main cam, not shown, provided with a plurality of cams on its shaft. The cam and arm in each position is acted upon by the main cam, to enable a predetermined operation. The position of the main cam M5030 can be detected by a position-detecting sensor, such as a photointerruptor. In lowering the cap M5010, the wiper M5020 moves vertically to the scanning direction of the carriage M4000, to clean the face surface of the printing head H1001. The wiper M5020 is provided in plurality, i.e. one for cleaning the vicinity of the nozzle of the printing head H1001 and one for cleaning the face surface entirety. The carriage M4000, when moved to the deepest position, becomes into abutment against a wiper cleaner M5060 so that the ink adhered on the wiper M5020 itself can be removed away.

(F) Outer Case

The above (A) to (E) explained units are mainly built in a chassis M1010, thus forming a mechanical part of the printing apparatus. The outer case is arranged in a manner covering around those. The outer case is mainly structured with a lower case M7080, an upper case M7040, an access cover M7030, a connector cover and a front cover M7010.

In a lower portion of the lower case M7080, a paper-discharging tray rail, not shown, is provided to receive a divided paper discharge tray M3160. Meanwhile, the front cover M7010 is structured to close a paper discharge aperture during non-use.

The upper case M7040 is attached with the access cover M7030 structured rotatable. The upper case has an aperture in a part of its upper surface, in which position the ink tank H1900 and the printing head H1001 can be exchanged. Incidentally, in the printing apparatus of the present embodiment, its head cartridge is structured with the ink tank H1900 removably attached independently on a color-by-color basis, for the printing head unit integrally structured with a plurality of colors of printing heads each capable of ejecting one color of ink. The upper case is further provided with a door switch lever, not shown, to detect an opening/closing of the access cover, an LED guide M7060 to transfer/display the light of an LED, a key switch M7070 to act upon the switch (SW) of a board, and so on. Meanwhile, a multi-stage paper feeding tray M2060 is rotatably attached. When the paper feeding section is not used, the paper feeding tray M2060 if retracted serves as a cover for the paper feeding section.

The upper case M7040 and the lower case M7080 are attached together by means of elastic engagement claws, between which there are arranged connectors over which a connector cover, not shown, covers.

(G) Flat-pass Printing Section

A printing medium is fed from the paper feed section in a state where the printing medium is bent, because the passage through which the printing medium passes continues curving up to the pinch rollers. For this reason, if a thicker printing medium with a thickness of approximately 0.5 mm or more, for example, is attempted to be fed from the paper feeding section, a reaction force of the bent printing medium occurs, and thus resistance to the paper feeding increases. As a result, it is likely that the printing medium cannot be fed. Otherwise, even if the printing medium can be fed, the delivered printing medium remains bent, or is folded. A flat-pass print is made on printing medium, such as thicker printing medium, which a user does not wish to fold, and on printing medium, such as CD-Rs, which cannot be bent.

Types of flat-pass prints include a type of print made by manually supplying a printing medium from a slit-shaped opening portion (under a paper feeding unit) in the back of the main body of a printing apparatus, and by thus causing pinch rollers of the main body to nip the printing medium. However, the flat-pass print of this embodiment employs the following mode. A printing medium is fed from the paper discharging port located in the front side of the main body of the printing apparatus to a position where a print is going to be made, and the print is made on the printing medium by switching back the printing medium.

The front cover M7010 is usually located below the paper discharging section, because the front cover M7010 is also used as a tray in which several tens of printing medium on which prints have been made are stacked (refer to FIG. 8). When a flat-pass print is going to be made, the front tray M7010 is elevated up to a position where the paper discharging port is located (refer to FIG. 12) for the purpose of supplying a printing medium from the paper discharging port horizontally in a direction reverse to the direction in which a printing medium is usually conveyed. Hooks and the like (not illustrated) are provided to the front cover M7010. Thus, the front cover M7010 is capable of being fixed to a position where the printing medium is supplied for the purpose of the flat-pass print. It can be detected by a sensor whether or not the front cover M7010 is located at the position where the printing medium is supplied for the purpose of the flat-pass print. Depending on this detection, it can be determined whether the printing apparatus is in a flat-pass printing mode.

In a flat-pass printing mode, by first pressing a flat-pass key E3004, a spur holder 3130 and a pinch roller holder M3000 are raised by a mechanism, not shown, higher than a medium thickness assumed. This allows a medium to be put on a front tray M7010 and inserted through the paper discharging opening. Meanwhile, by pressing a rear tray button M7110, a rear tray M7090 is opened. Furthermore, a rear sub-tray M7091 can be opened in V-form. The rear tray M7090 and the rear sub-tray M7091 are trays for supporting a long medium also at the backside of the body because a long medium if inserted from the front of the body is to eject at the backside of the body. A thick medium, if not kept in a flat position during printing, possibly has an effect upon print quality due to a change of conveyance load if constituting a cause of head scrape.

By the sequence, the medium is allowed to be inserted in the body through the paper discharging opening (for a medium having a length not protruding at the backside of the body upon switch back, there is no need to open the rear tray M7090). The medium at its front is aligned, at a right end, with a mark on the front tray M7010 similarly to the paper feeding section, thus being put on the front tray M7010.

In case the flat-pass key E3004 is pressed here, the spur holder 3130 lowers so that the medium is nipped by the paper discharging roller M3100, 3110 and the spur wheel 3120. Then, the medium is drawn a predetermined amount into the body by means of the paper discharging roller M3100, 3110 (oppositely to a printing direction, in a paper feeding direction of flat pass) Concerning the predetermined amount, because the medium first set up is aligned in a front-rear position at the front side of the medium, a short medium does not reach the conveying roller M3060. The predetermined distance is provided by a distance over which the shortest medium assumed reaches the conveying roller M3060.

Because the medium fed the predetermined amount reaches the conveying roller M3060, in which position the pinch roller holder M3000 is lowered to nip the medium by the conveying roller M3060 and the pinch roller M3070. This completes the paper feed upon flat pass of the medium (print standby position). Because a weak nip force of the paper discharging roller 3100, 3110 and the paper discharging roller, the medium possibly deviates in position before printing. Because of a strong nip force of the conveying roller M3060 and the pinch roller M3070, the medium is to be positively determined in its setup position. Meanwhile, when feeding the medium a predetermined amount into the body, the paper at its leading edge is detected in position by the flat-pass paper detecting sensor M3170 provided between a platen M3040 and the spur holder M3130.

In the print standby status, a print command is executed. The medium is moved to a printing site by the conveying roller M3060, followed by making a printing as in the usual printing. After printing, the paper is discharged onto the front tray M3010.

When printing is desirably continued with flat-pass printing, the printed medium is taken out of the front tray M7010. From then on, the sequence mentioned before is repeated. Specifically, it begins with medium setup by raising the spur holder M3130 and the pinch roller holder M3000 through pressing the flat-pass key E3004.

For terminating the flat-pass printing, the mode is returned to the usual printing mode by bringing the front tray M7010 back to the usual printing position.

The fine art paper employed in the invention, in many cases, is comparatively thick, i.e. a paper thickness of approximately from 0.3 to 0.5 mm. For this reason, by feeding a paper by use of the flat-pass printing section as described here, it is possible to prevent the occurrence of non-feed upon feeding a paper and to avoid a head scrape that the printing head scrapes the surface of a printing medium.

(H) Wetting Liquid Transferring Unit

In the case of using solely pigmented ink, the surface having ejection openings is readily damaged if wiping the surface having ejection openings in a state pigmented ink is left thereon.

For this reason, the surface having ejection openings is prevented from deteriorating with pigmented ink by putting a solution on a blade M5020 and then wiping the wetted blade M5020, i.e. wet wiping.

M5090 is a wetting liquid tank containing, for example, a glycerin solution to be put on the blade. M5100 is a wetting-liquid hold member that is a fibrous member or the like having a proper surface tension not to leak the wetting liquid from the wetting-liquid tank M5090 and impregnated with wetting liquid.

M5080 is a wetting-liquid transferring member having a wetting-liquid transferring unit M5081 contacting with the blade. For example, it is of a material porous and having a suitable capillary force. Because the wetting-liquid transferring member M5080 is in contact with a wetting-liquid hold member M5090 impregnated with wetting liquid, wetting solution soaks in the wetting-liquid transferring member M5080. The wetting-liquid transferring member M5080 is of a material having a capillary force to supply wetting liquid to the wetting-liquid transferring unit M5081 even if the wetting liquid remains less in amount.

When the carriage M4000 is in a retracted position where is not in contact with the blade M5020, the blade M5020 is brought into contact with the wetting-liquid transferring unit M5081 through passing the underneath of the blade cleaner M5060 (in the −Y direction) (FIG. 16). By contact for a proper time, wetting liquid is transferred properly in amount to the blade M5020.

Although the blade M5020 then moves in the +Y direction, it goes into contact with the blade cleaner M5060 at its surface not transferred with wetting liquid. Thus, the wetting liquid remains transferred on the blade M5020.

After bring the blade back to the wiping start position, the carriage M4000 is moved to a wiping site. By moving the blade M5020 again in the −Y direction, the printing head H1001 can be wiped by means of the surface put with wetting liquid.

By putting a solution onto the blade M5020 and then wiping the wetted blade M5020, deterioration can be prevented for the pigmented-ink ejection surface. Wiping is possible to perform solely with pigmented ink.

3. Compatible Printing Media

Description is made here on the type of printing medium (medium) which the printing apparatus in the embodiment is compatible with. The ink jet printer has merits one of which lies in being not selective of its printing medium. For example, printing is possible not only on the usual medium, such as plain paper, coat paper or glossy paper but also on a small-sized paper, such as a postcard or a card. Besides, printing can be made on a medium in an especial form such as a printable CD and printable DVD coated with an ink acceptable layer on the surface thereof, by use of an exclusive tray. Meanwhile, the printing apparatus in the embodiment has a flat-pass mechanism, thus being allowed for printing also on a comparatively thick medium, e.g. fine art paper, and on a non-bendable medium, e.g. board paper.

The fine art paper, referred here, employs a neutral paper using a cotton fiber in its base material, thus having an improved storage capability of its paper itself. Meanwhile, there is contained a fluorescent whitener for improving the paper whiteness as contained in the usual ink jet paper. However, because the paper problematically becomes yellowish if stored over a long term, such a fluorescent whitener frequently is not used in a fine art paper. Meanwhile, because the fine art paper has a characteristic that bonding (internal bond strength) is weak between paper fibers, its fibers tend to separate at a paper surface and turned into a paper powder.

4. Configuration of Electrical Circuit

Descriptions will be provided next for a configuration of an electrical circuit of this embodiment.

Figure 18:
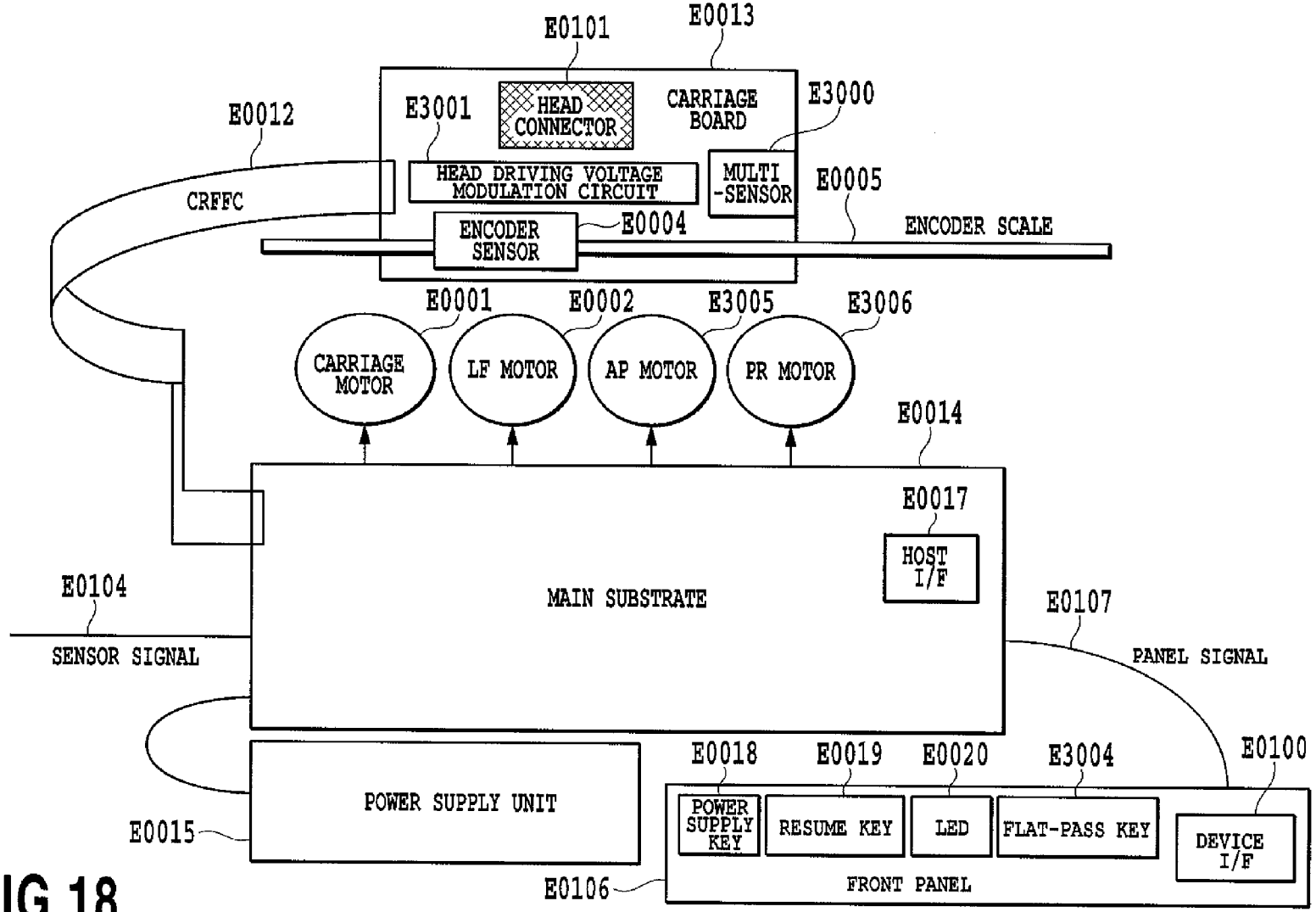
FIG. 18 is a block diagram schematically showing the entire configuration of an electrical circuit in the embodiment of the present invention.

FIG. 18 is a block diagram for schematically describing the entire configuration of the electrical circuit in the printing apparatus J0013. The printing apparatus to which this embodiment is applied is configured chiefly of the carriage board E0013, the main substrate E0014, a power supply unit E0015, a front panel E0106 and the like.

The power supply unit E0015 is connected to the main substrate E0014, and thus supplies various types of drive power.

The carriage board E0013 is a printed circuit board unit mounted on the carriage M4000. The carriage board E0013 functions as an interface for transmitting signals to, and receiving signals from, the printing head H1001 and for supplying head driving power through the head connector E0101. The carriage board E0013 includes a head driving voltage modulation circuit E3001 with a plurality of channels to the respective ejecting portions of the printing head H1001. The plurality of ejecting portions corresponding respectively to the plurality of mutually different colors. In addition, the head driving voltage modulation circuit E3001 generates head driving power supply voltages in accordance with conditions specified by the main substrate E0014 through the flexible flat cable (CRFFC) E0012. In addition, change in a positional relationship between the encoder scale E0005 and the encoder sensor E0004 is detected on the basis of a pulse signal outputted from the encoder sensor E0004 in conjunction with the movement of the carriage M4000. Moreover, the outputted signal is supplied to the main substrate E0014 through the flexible flat cable (CRFFC) E0012.

Figure 20:
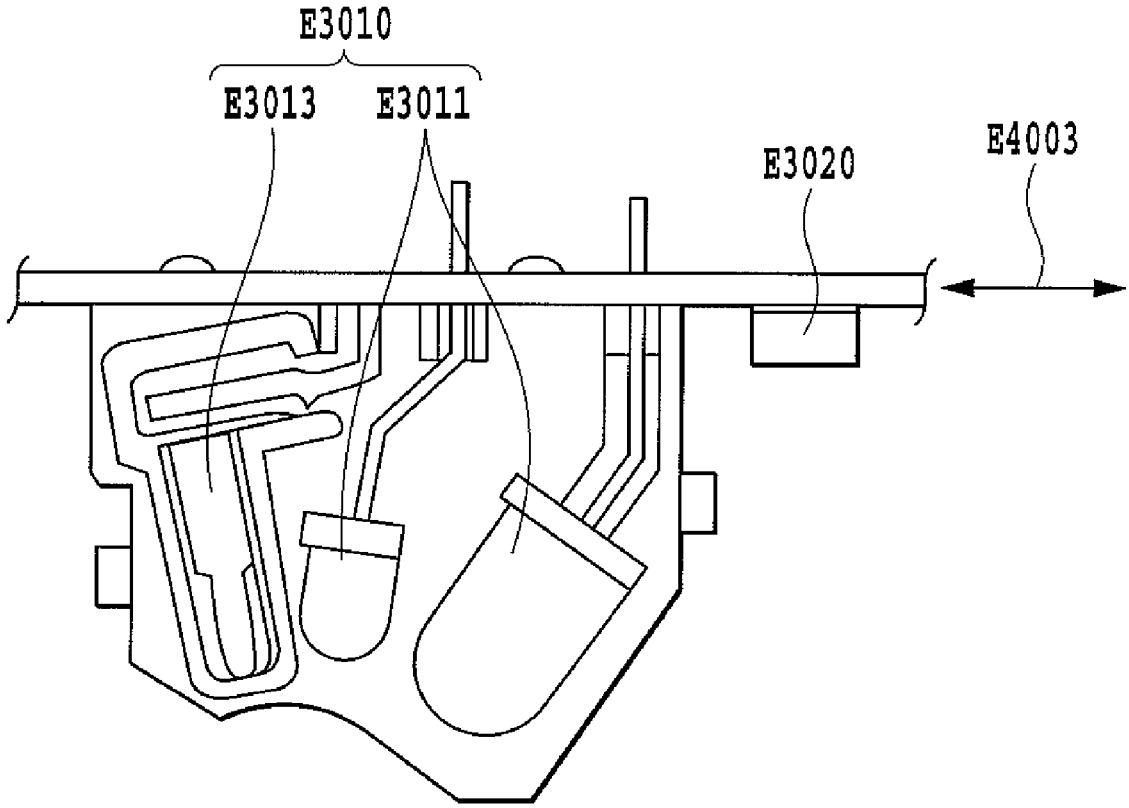
FIG. 20 is a diagram showing an example of a configuration of a multisensor system mounted on a carriage board shown in FIG. 18.

An optical sensor E3010 and a thermistor E3020 are connected to the carriage board E0013, as shown in FIG. 20. The optical sensor E3010 is configured of two light emitting devices (LEDs) E3011 and a light receiving element E3013. The thermistor E3020 is that with which an ambient temperature is detected. Hereinafter, these sensors are referred to as a multisensor system E3000. Information obtained by the multisensor system E3000 is outputted to the main substrate E00014 through the flexible flat cable (CRFFC) E0012.

The main substrate E0014 is a printed circuit board unit which drives and controls each of the sections of the ink jet printing apparatus of this embodiment. The main substrate E0014 includes a host interface (host I/F) E0017 thereon. The main substrate E0014 controls print operations on the basis of data received from the host apparatus J0012 (FIG. 1). The main substrate E0014 is connected to and controls various types of motors including the carriage motor E0001, the LF motor E0002, the AP motor E3005 and the PR motor E3006. The carriage motor E0001 is a motor serving as a driving power supply for causing the carriage M4000 to perform main scan. The LF motor E0002 is a motor serving as a driving power supply for conveying printing medium. The AP motor E3005 is a motor serving as a driving power supply for causing the printing head H1001 to perform recovery operations. The PR motor E3006 is a motor serving as a driving power supply for performing a flat-pass print operation; and the main substrate E0014 thus controls drive of each of the functions. Moreover, the main substrate E0014 is connected to sensor signals E0104 which are used for transmitting control signals to, and receiving detection signals from, the various sensors such as a PF sensor, a CR lift sensor, an LF encoder sensor, and a PG sensor for detecting operating conditions of each of the sections in the printer. The main substrate E0014 is connected to the CRFFC E0012 and the power supply unit E0015. Furthermore, the main substrate E0014 includes an interface for transmitting information to, and receiving information from a front panel E0106 through panel signals E0107.

The front panel E0106 is a unit provided to the front of the main body of the printing apparatus for the sake of convenience of user's operations. The front panel E0106 includes the resume key E0019, the LED guides M7060, the power supply key E0018, and the flat-pass key E3004 (refer to FIG. 6). The front panel E0106 further includes a device I/F E0100 which is used for connecting peripheral devices, such as a digital camera, to the printing apparatus.

Figure 19:
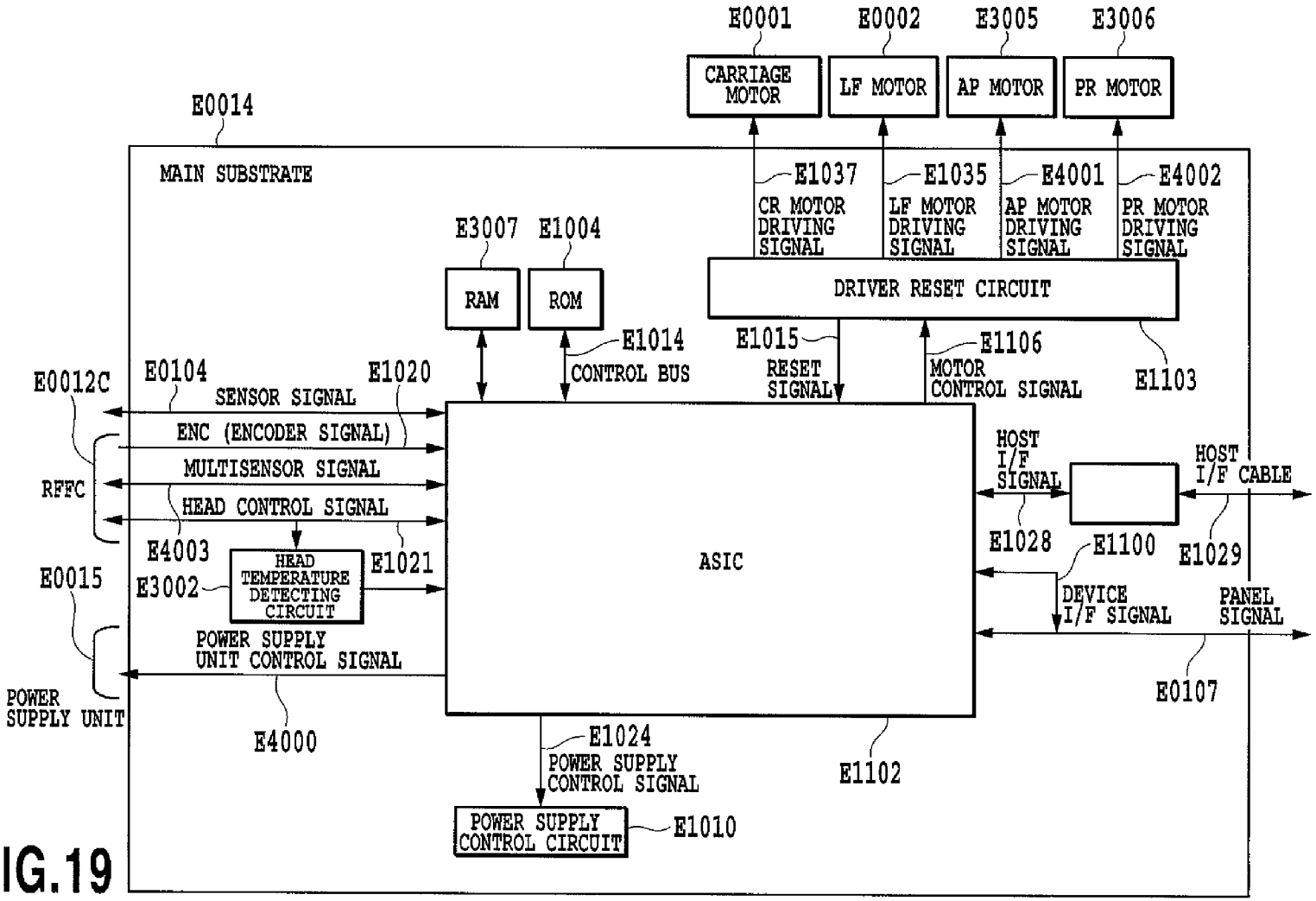
FIG. 19 is a block diagram showing an example of an internal configuration of a main substrate shown in FIG. 18.

FIG. 19 is a block diagram showing an internal configuration of the main substrate E1004.

In FIG. 19, reference numeral E1102 denotes an ASIC (Application Specific Integrated Circuit). The ASIC E1102 is connected to a ROM E1004 through a control bus E1014, and thus performs various controls in accordance with programs stored in the ROM E1004. For example, the ASIC E1102 transmits sensor signals E0104 concerning the various sensors and multisensor signals E4003 concerning the multisensor system E3000. In addition, the ASIC E1102 receives sensor signals E0104 concerning the various sensors and multisensor signals E4003 concerning the multisensor system. Furthermore, the ASIC E1102 detects encoder signals E1020 as well as conditions of outputs from the power supply key E0018, the resume key E0019 and the flat-pass key E3004 on the front panel E0106. In addition, the ASIC E1102 performs various logical operations, and makes decisions on the basis of conditions, depending on conditions in which the host I/F E0017 and the device I/F E0100 on the front panel are connected to the ASIC E1102, and on conditions in which data are inputted. Thus, the ASIC E1102 controls the various components, and accordingly drives and controls the ink jet printing apparatus.

Reference E1103 denotes a driver reset circuit. In accordance with motor controlling signals E1106 from the ASIC E1102, the driver reset circuit E1103 generates CR motor driving signals E1037, LF motor driving signals E1035, AP motor driving signals E4001 and PR motor driving signals 4002, and thus drives the motors. In addition, the driver reset circuit E1103 includes a power supply circuit, and thus supplies necessary power to each of the main substrate E0014, the carriage board E0013, the front panel E0106 and the like. Moreover, once the driver reset circuit E1103 detects drop of the power supply voltage, the driver reset circuit E1103 generates reset signals E1015, and thus performs initialization.

Reference numeral E1010 denotes a power supply control circuit. In accordance with power supply controlling signals E1024 outputted from the ASIC E1102, the power supply control circuit E1010 controls the supply of power to each of the sensors which include light emitting devices.

The host I/F E0017 transmits host I/F signals E1028, which are outputted from the ASIC E1102, to a host I/F cable E1029 connected to the outside. In addition, the host I/F E0017 transmits signals, which come in through this cable E1029, to the ASIC E1102.

Meanwhile, the power supply unit E0015 supplies power. The supplied power is supplied to each of the components inside and outside the main substrate E0014 after voltage conversion depending on the necessity. Furthermore, power supply unit controlling signals E4000 outputted from the ASIC E1102 are connected to the power supply unit E0015, and thus a lower power consumption mode or the like of the main body of the printing apparatus is controlled.

The ASIC E1102 is a single-chip semiconductor integrated circuit incorporating an arithmetic processing unit. The ASIC E1102 outputs the motor controlling signals E1106, the power supply controlling signals E1024, the power supply unit controlling signals E4000 and the like. In addition, the ASIC E1102 transmits signals to, and receives signals from, the host I/F E0017. Furthermore, the ASIC E1102 transmits signals to, and receives signals from, the device I/F E0100 on the front panel by use of the panel signals E0107. As well, the ASIC E1102 detects conditions by means of the sensors such as the PE sensor and an ASF sensor with the sensor signals E0104. Moreover, the ASIC E1102 controls the multisensor system E3000 with the multisensor signals E4003, and thus detects conditions. In addition, the ASIC E1102 detects conditions of the panels signals E0107, and thus controls the drive of the panel signals E0107. Accordingly, the ASIC E1102 turns on/off the LEDs E0020 on the front panel.

The ASIC E1102 detects conditions of the encoder signals (ENC) E1020, and thus generates timing signals. The ASIC E1102 interfaces with the printing head H1001 with head controlling signals E1021, and thus controls print operations. In this respect, the encoder signals (ENC) E1020 are signals which are receives from the CRFFC E0012, and which have been outputted from the encoder sensor E0004. In addition, the head controlling signals E1021 are connected to the carriage board E0013 through the flexible flat cable E0012. Subsequently, the head controlling signals E1021 are supplied to the printing head H1001 through the head driving voltage modulation circuit E3001 and the head connector E0101. Various types of information from the printing head H1001 are transmitted to the ASIC E1102. Signals representing information on head temperature of each of the ejecting portions among the types of information are amplified by a head temperature detecting circuit E 3002 on the main substrate, and thereafter the signals are inputted into the ASIC E1102. Thus, the signals are used for various decisions on controls.

In the figure, reference numeral E3007 denotes a DRAM. The DRAM E3007 is used as a data buffer for a print, a buffer for data received from the host computer, and the like. In addition, the DRAM is used as work areas needed for various control operations.

5. Configuration of Printing Head

Descriptions will be provided below for a configuration of the head cartridge H1000 to which this embodiment is applied.

The head cartridge H1000 in this embodiment includes the printing head H1001, means for mounting the ink tanks H1900 on the printing head H1001, and means for supplying inks from the respective ink tanks H1900 to the printing head H1001. The head cartridge H1000 is detachably mounted on the carriage M4000.

Figure 21:
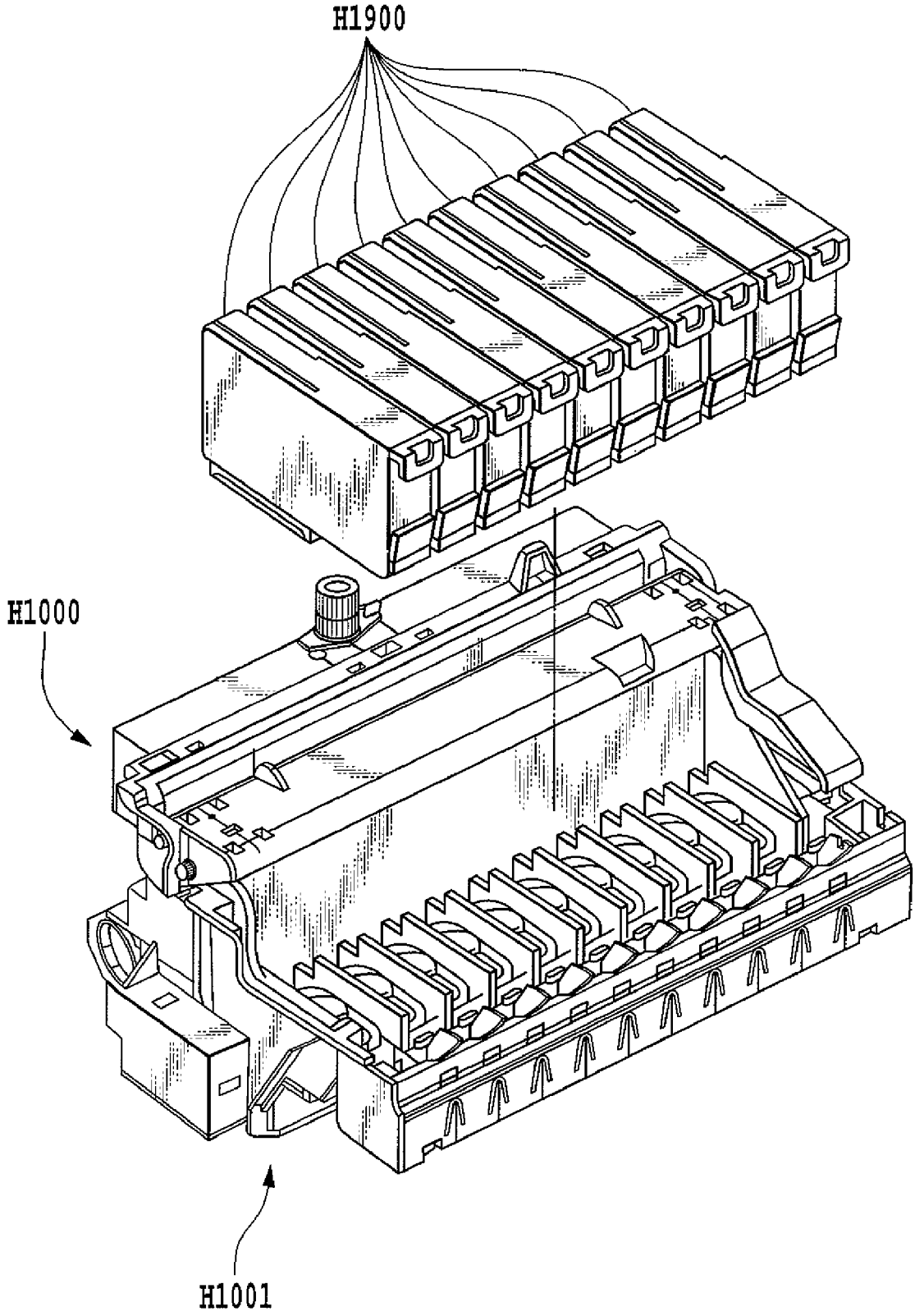
FIG. 21 is a perspective view of a head cartridge and ink tanks applied in the embodiment, which shows how the ink tanks are attached to the head cartridge.

FIG. 21 is a diagram showing how the ink tanks H1900 are attached to the head cartridge H1000 to which this embodiment is applied. The printing apparatus of this embodiment forms an image by use of the pigmented inks corresponding respectively to the ten colors. The ten colors are cyan (C), light cyan (Lc), magenta (M), light magenta (Lm), yellow (Y), black 1 (K1), black 2 (K2), red (R), green (G) and gray (Gray). For this reason, the ink tanks H1900 are prepared respectively for the ten colors. As shown in FIG. 21, each of the ink tanks can be attached to, and detached from, the head cartridge H1000. Incidentally, the ink tanks H1900 are designed to be attached to, and detached from, the head cartridge H1000 in a state where the head cartridge H1000 is mounted on the carriage M4000.

Figure 22:
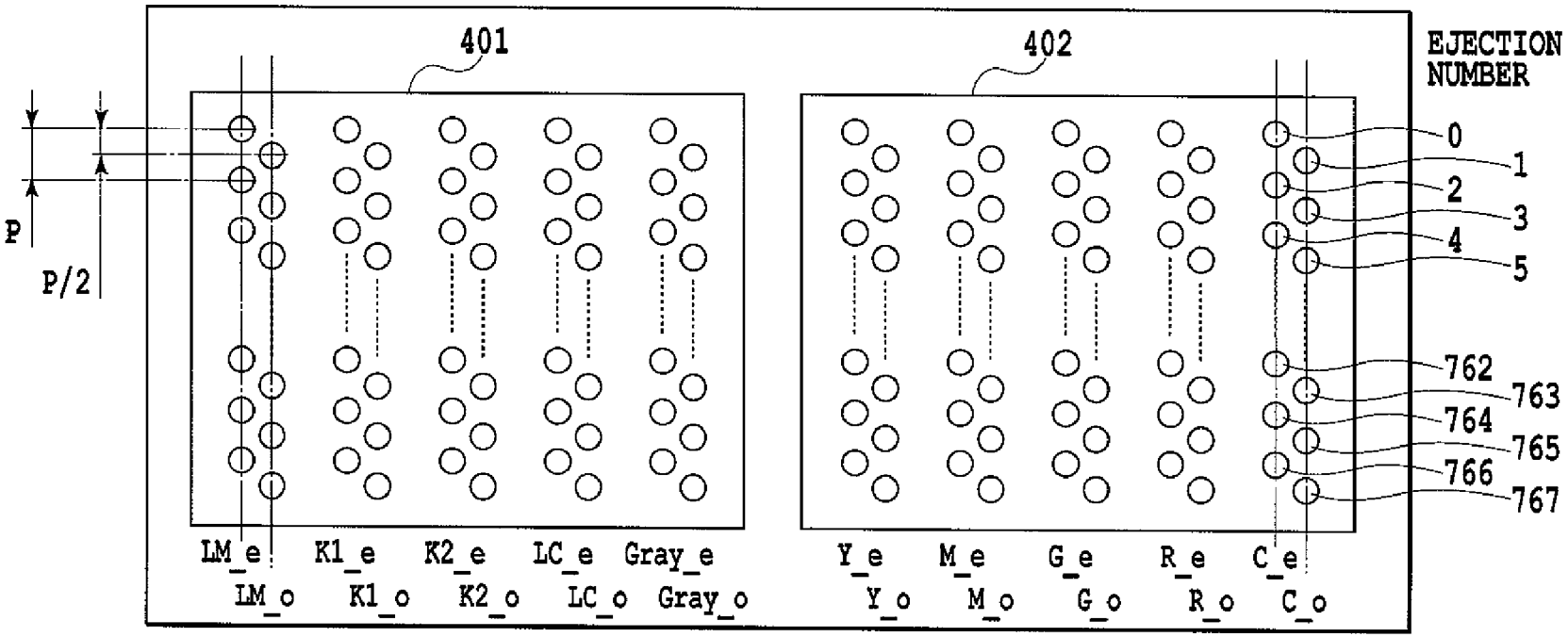
FIG. 22 is a view typically showing ejection-opening arrays, for respective ink colors in the printing head, for use in a first embodiment of the invention.

The printing head H1001, used in the embodiment, is explained by using FIG. 22 typically illustrating the ejection-opening arrays provided on a color-by-color basis of ink. The figure represents the arrangement of ejection-opening arrays as viewed from the surface side having ejection surfaces of the printing head H1001, wherein the printing head in the embodiment is structured with two chips 401, 402. Furthermore, in each chip, ejection openings are parallel arranged two in arrays for ejecting each of five colors of ink. In the chip 401, ejection openings are arranged two in arrays for ejecting each of LM, K1, K2, LC and Gray of ink, i.e. ejection openings totally ten in arrays. For each ink color, the ejection openings are arranged at a pitch (P) corresponding to 600 dpi in each of the two arrays. Meanwhile, the ejection openings are arranged deviated a pitch (P/2) corresponding to 1200 dpi between the two arrays. Provided that the ejection openings are respectively assigned with numbers 0 to 67 in the figure, LM_e represents an even-numbered array where arranged are ejection openings even numbered as 0, 2, 4, . . . 766. Likewise, LM_o represents an odd-numbered array where arranged are ejection openings odd numbered as 1, 3, 5, . . . 767. In this manner, ejection openings are formed in two, or odd and even, arrays similarly for the other colors of ink.

6. Printing

Figure 23:
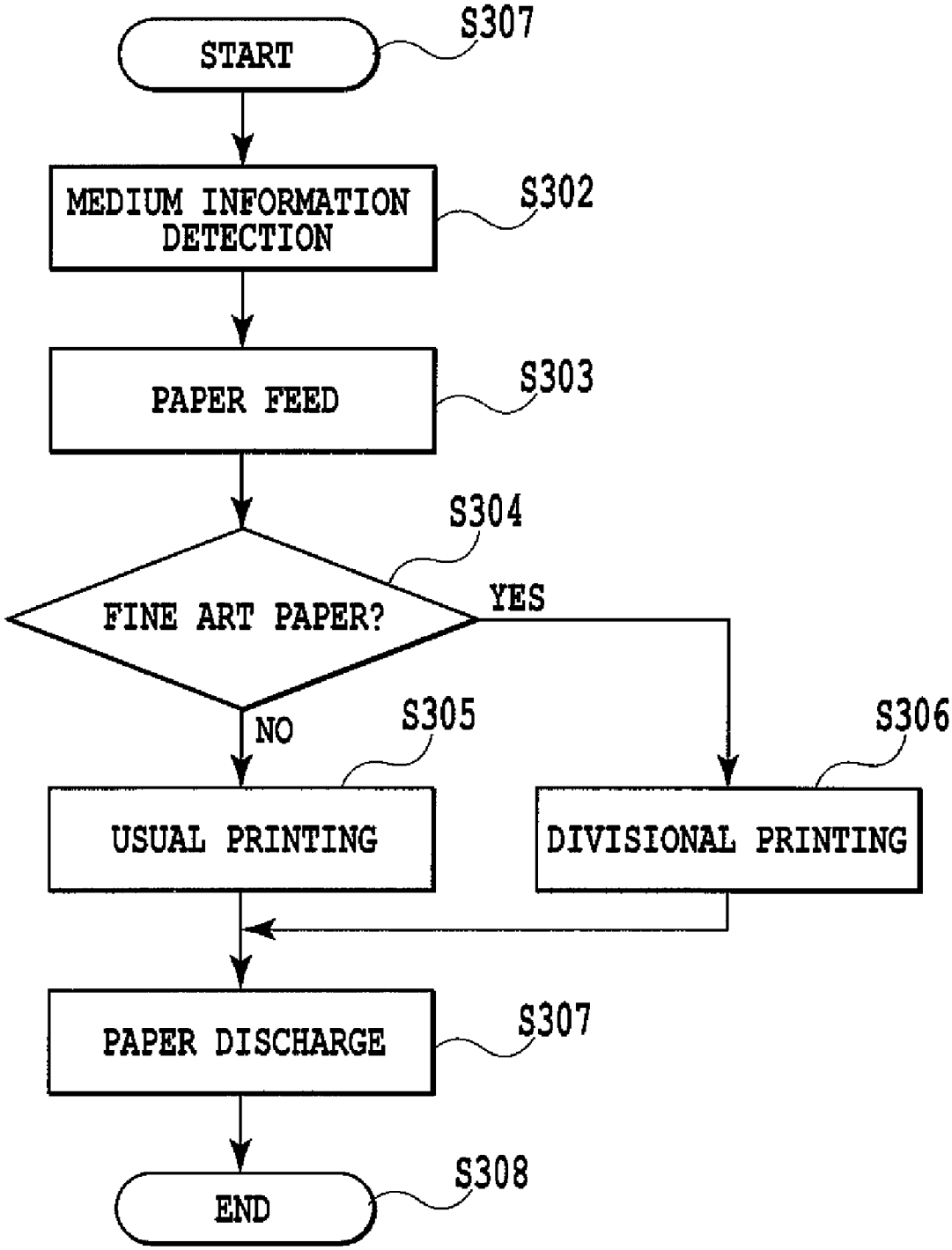
FIG. 23 is a flowchart showing a printing method in a first embodiment of the invention.

FIG. 23 is a flowchart showing a printing method in a first embodiment of the invention. After the settings of paper type, print quality and copies by means of the printer driver of a host apparatus, a print command is issued to start the printing method according to the present embodiment (S301). At step S302, detection is conducted for the medium information in the print data shown in FIG. 2. Namely, determination is made as to whether the selected medium (printing medium) is a medium that less causes scattering substance during printing, e.g. glossy paper or coated paper, or a medium that much causes scattering substance during printing, e.g. fine art paper.

Then, at step S303, a printing medium is fed. In this case, paper feed is from the foregoing flat-pass section as to a medium comparatively thick, e.g. fine art paper. For a comparatively thin medium other than that, paper feed is from the paper feeding section already explained in the mechanical part structure.

At step S304, determination is made as to whether a fine art paper or not, based on the content of the medium information detected at the step S302. When determined as a fine art paper, the process moves to step S306 where printing is performed according to a divisional printing method less producing paper powders as referred later (divisional printing). At the step S306, an ejection opening for use in printing to a fine art paper is first determined out of a plurality of ejection openings in the adjacent arrays (LM_e, LM_o). Then, divisional printing is performed by use of the determined ejection opening. Meanwhile, in the case of a medium other than fine art paper that is less produces paper powders, the process moves to step S305 where printing (usual printing) is performed according to the usual printing scheme. At the step S305, an ejection opening for use in printing to a paper other than fine art paper is first determined out of a plurality of ejection openings on the adjacent arrays (LM_e, LM_o). Then, divisional printing is performed by use of the determined ejection opening.

Here, explanation is made on the difference between the usual printing at S305 and the divisional printing at S306. At the S306, divisional printing is performed for printing on a medium ready to cause paper powders, e.g. fine art paper. Namely, in order to relieve the soar of the paper powder caused by the airflow through the two arrays of ejection openings, printing scan is performed by use of one of the two arrays of ejection openings on each of the ink colors. The ejection-opening array used is changed alternately scan by scan. Specifically, explanation is made by noticing those for LM ink of the ejection-opening arrays of the printing head shown in FIG. 22. Out of two LM ejection-opening arrays, i.e. even-numbered column array LM_e and odd-numbered array LM_o, printing is made by use of an even-numbered array LM_e in the n-th scanning. In the next (n+1)-th scanning, printing is with an odd-numbered array LM_o.

For example, where the number of passes is eight in multi-pass print, the thinning-out ratio of a printing image in once pass is 12.5% in average per ink color. In the case of the usual printing at step S305, the average thinning-out ratio of the first to eighth pass is 12.5% on each of the nozzle arrays. Meanwhile, where the even-numbered array and the odd-numbered array are used alternately as in a divisional printing at S306, the average thinning-out ratio of the first to eighth pass is 25%, 0%, 25%, 0%, 25%, 0%, 25% and 0%. Meanwhile, as for the odd-numbered array, it is provided as 0%, 25%, 0%, 25%, 0%, 25%, 0% and 25%.

In this manner, in the present embodiment, the ejection openings for use are changed between the case of making a printing to a medium on which paper powder is ready to occur and the case of making a printing to a medium on which paper powder is not ready to occur. Specifically, for a medium on which paper powder is ready to occur, paper powder is reduced in generation amount by restricting the number of the ejection openings for use out of the ejection openings belonging to the two ejection-opening arrays mutually adjacent (adjacent ejection openings) along the direction intersecting with the arrangement direction of the ejection openings during relatively movement.

Figure 24A:
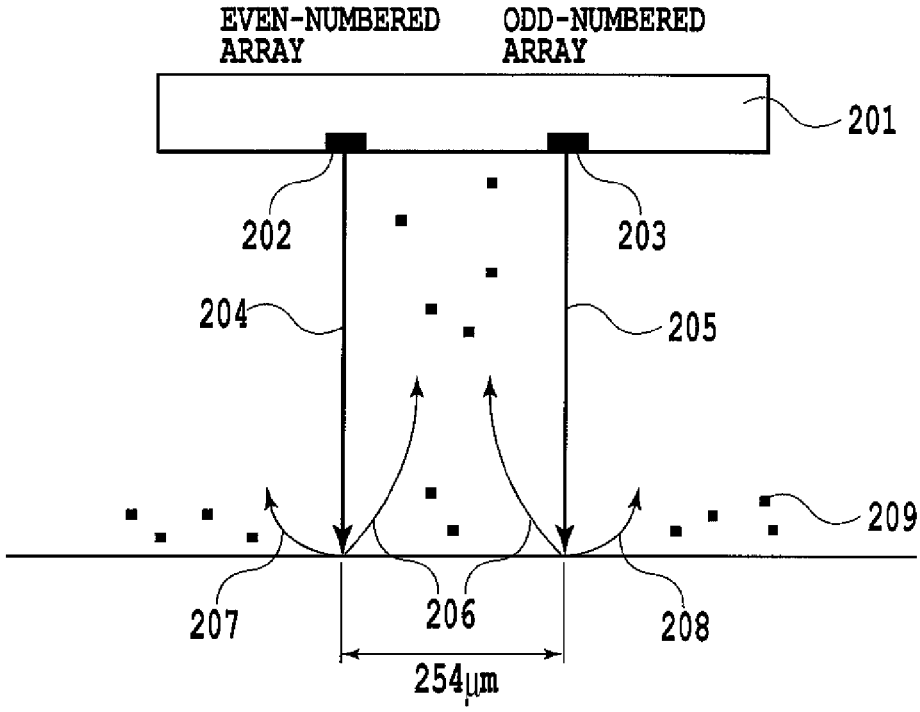
FIGS. 24A and 24B are figures explaining the soar of a paper powder where the two arrays of ejection openings are used at the same time and where those are used one array per time, in the first embodiment of the invention.
Figure 24B:
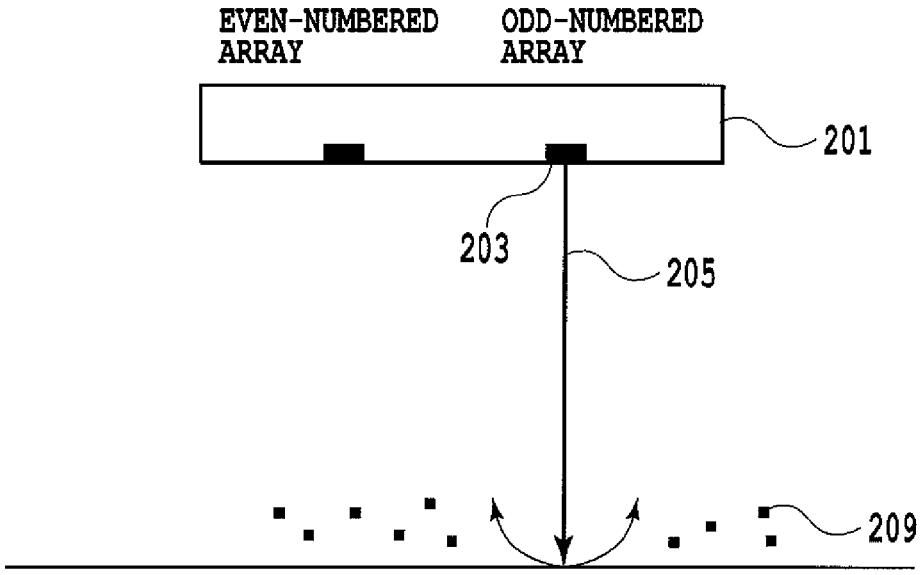

When the inputted print data is completely printed according to the printing method like this, the process moves to step S307 where the medium is discharged, followed by terminating the printing at S308. FIGS. 24A and 24B are figures explaining the soar of paper powder where the two arrays of ejection openings are used at the same time and where those are used at one array in one time. The figures illustrate a section of a space between the printing head and the printing medium, in a direction orthogonal to the main scanning direction of the printing head.

FIG. 24A is a figure explaining an airflow occurring upon simultaneous use of both the even and odd numbered arrays nozzles and a soar of a paper powder caused by the same. Between an even-numbered array 202 of ejection openings and an odd-numbered array 203 of ejection openings that are arranged in the printing head 201, there is given a spacing in an amount of 1200 dpi times 12 pixels, i.e. 254 μm. The airflows, caused under the influence of ink droplet ejections at even and odd numbered arrays of ejection openings, are typically illustrated at 204, 205. As shown in the figure, an airflow occurs downward from the printing head toward a paper surface. Although the downward airflow is attenuated in its intensity by the air resistance between the printing head and the paper, the airflow reached the paper surface turns into an airflow rising toward the printing head as shown at 207 and 208. By the rising airflow, the paper powder existing on the paper surface is soared as shown at 209, thus being suspended between the printing head and the paper surface. However, the paper powder, soaring with the airflows 207, 208 occurring outer of the two ejection openings, is pushed back by the downward airflows 204, 205 caused by the succeeding ink droplet ejections and hence not allowed to reach the printing head. Meanwhile, a pressure reduced state is caused in the region between the two ejection-opening arrays under the influence of the downward airflow. The rising airflow 206 from the paper surface is less attenuated as compared to the airflow on the outer side and hence allowed to reach the near of the printing head surface. Accordingly, the paper powder, soared by the airflow 206, rises to the near of the ejection opening of the printing head thus being suspended there. Moreover, the space between the two ejection-opening arrays is confined by the two arrays of airflows 204, 205. Thus, the soaring paper powder is placed in a confined state, ultimately leading to a state that is ready to be put on the vicinity of the ejection openings.

Meanwhile, FIG. 24B typically shows the airflow where odd-numbered arrays only are used and the state of paper powder soaring. By using only the odd-numbered array 203, the paper powder soared by airflow is pushed back by the downward airflow caused by the succeeding ink droplet ejections, thus not allowed to reach the printing head. Consequently, there is no occurrence of paper powder adhesion to the vicinity of the ejection openings.

By thus permitting to use only one array of ejection openings out of the adjacent arrays of ejection openings in one scanning while not permitting to use the other array of ejection openings, airflow can be suppressed between the ejection-opening arrays with a result that the paper powder is relieved in amount from soaring due to airflow.

FIG. 25 is a figure explaining what degree decreased is the occurrence of non-ejection due to paper powder adhesion where printing is made by the printing method according to the present embodiment. The present table shows the counted number of occurrences of ink non-ejection at the ejection openings for each ink color, by conducting an experiment with a divisional printing restrictedly using only one array of ejection openings, used in the embodiment, and a usual printing using the two arrays at the same time. Specifically, an A4-size image is printed one on a fine art paper ready to cause paper powder, followed by confirming the number of ejection openings, where ink non-ejection is caused by a paper powder, out of 768 ejection openings on each ink color from a print result of check patterns.

In the usual printing, non-ejection occurred at 18 ejection openings out of all the ejection openings for 10 colors. In the printing apparatus of the present embodiment, ejection openings are provided as many as 768 for each ink color and arranged at high density so that non-ejection, if caused at several ejection openings or so, cannot have a significant effect upon a printed image. However, where there are non-ejections at as many as 18 ejection openings, printing quality is influenced greatly. Meanwhile, it has been experimentally revealed that, with divisional printing, paper powder adhesion does not occur when printing an A4-size sheet without encountering non-ejections.

Incidentally, the present embodiment implements printing under control of the control means provided on a main board of the printing apparatus.

Second Embodiment

In the first embodiment, the ejection-opening arrays were used alternately at the even-numbered array and the odd-numbered array on the printing head. Namely, when performing divisional printing, printing was made alternately with each of the ejection-opening arrays, i.e. using the ejection openings on the even-numbered array in the n-th scanning while using the ejection openings on the odd-numbered array in the next (n+1)-th scanning. However, the invention is not restricted to such a scheme.

Figure 26A:
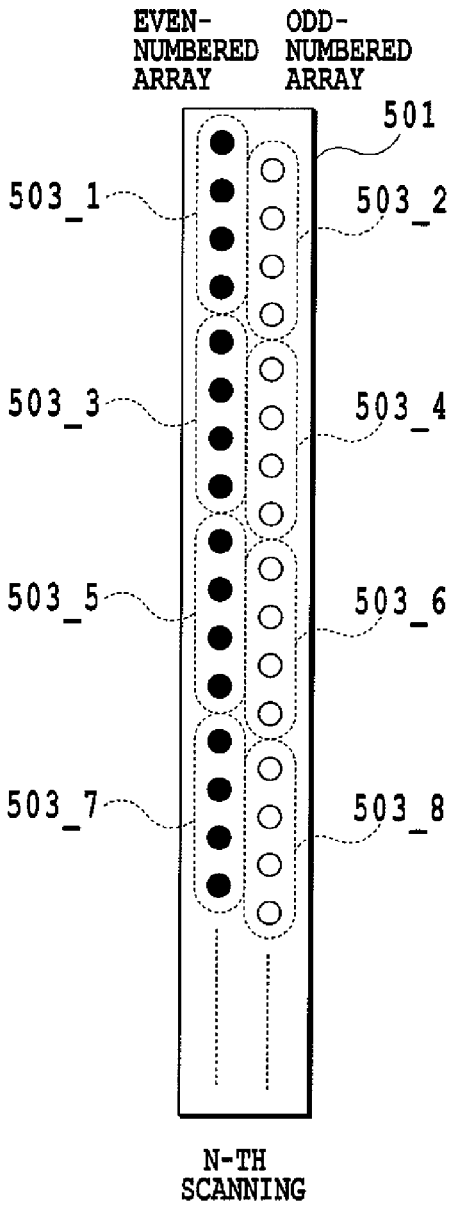
FIGS. 26A and 26B are views explaining divisional printing in a second embodiment of the invention.
Figure 26B:
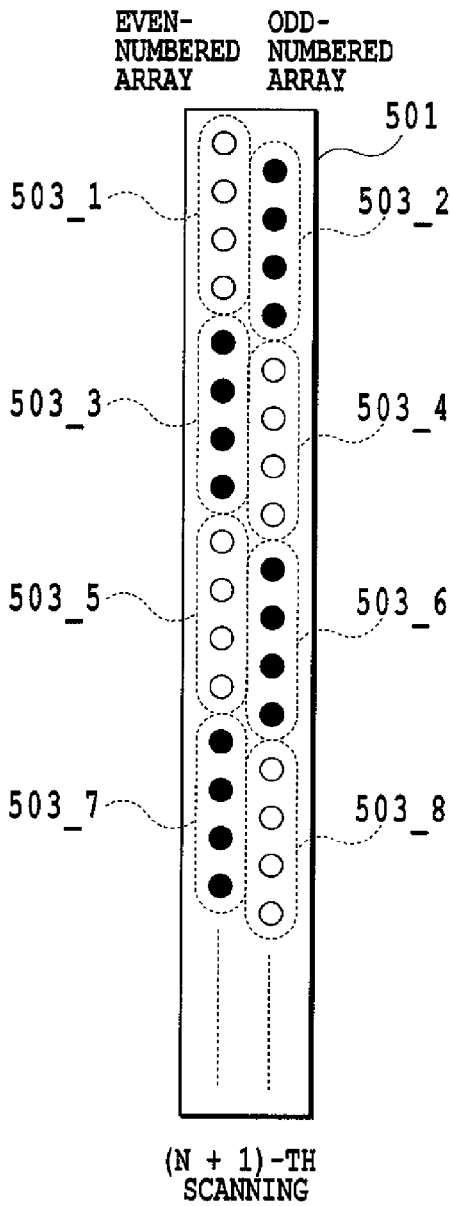

FIGS. 26A and 26B are views explaining the divisional printing in a second embodiment. In the figures, there are shown two, or even and odd numbered, arrays of ejection openings of the printing head for ejecting a certain one color of ink, wherein the ejection openings for use in once (single) scanning are shown in solid black. As illustrated in the figure, division is made into ejection opening groups on an array-by-array basis in the embodiment by taking one set with four ejection openings. Note that, although one set is taken with four ejection openings in the embodiment, ejection-opening arrays are satisfactorily divided in units of a plurality of ejection openings without restricted to the structure taking one set with four ejection openings. In also the second embodiment, paper powder is reduced in generation amount by restricting the number of the ejection openings for use out of the ejection openings belonging to the adjacent two arrays of ejection openings similarly to the first embodiment. Particularly, it is effective in reducing the amount of paper powder to permit the use of only one array of ejection openings out of the adjacent arrays of ejection openings in one scanning while not permitting to use the other array of ejection openings.

In FIG. 26A, the ejection openings for use in the N-th pass scanning of multi-pass print are depicted in solid black in the positions thereof. Namely, when performing an N-th pass scanning, a group of ejection openings 503_1, 503_5 . . . is used as to the even-numbered array while a group of ejection openings 503_4, 503_8 . . . is used as to the odd-numbered array. Although omitted in the figure, each array has 384 ejection openings. Consequently, those are divided as 96 (=384÷4) groups of ejection openings.

As for the even-numbered array, the ejection-opening groups for use and the ejection-opening groups not for use are positioned alternately every other group such that the ejection-opening for use are provided as 503_1, 503_5 . . . Meanwhile, as for the odd-numbered array, the ejection-opening groups for use and the ejection-opening groups not for use are positioned alternately every other group such that those are in an exclusive relationship with the groups on the even-numbered array adjacent in the main scanning direction.

In FIG. 26B, the ejection openings for use in the (N+1)-th pass scanning of multi-pass print are depicted in solid black. In FIG. 26B, the ejection openings not for use in FIG. 26A are used while the ejection openings for use in FIG. 26A are not used. From then on, the use form of ejection opening groups is alternately repeated as shown in FIGS. 26A and 26B in the course of repeating the pass.

By thus using the ejection opening groups at the odd and even arrays in a manner of exclusive relationship with the ejection opening groups adjacent in the sub-scanning direction, paper powder can be suppressed in soaring amount as compared to the case using the adjacent groups of ejection openings on the two arrays at the same time. Namely, in the ejection opening groups adjacent in the sub-scanning direction, if ejection is made at one side then no ejection is caused at the other side thus not causing a situation of airflow shown in FIG. 24A. Namely, a situation results that a rising airflow is suppressed as in FIG. 24B. Therefore, in the present embodiment, printing can be made while suppressing the paper powder soar that is easy to occur from a fine art paper.

Incidentally, in the embodiment, ejection was made exclusively at the even and odd arrays by dividing each array of ejection openings in units of four. However, the invention is not restricted to such division. Namely, the number of ejection opening groups may be changed. Besides, the ejection opening groups for use may be not changed every scanning but may be changed at an interval of a plurality greater than two scans.

As described so far, in the present embodiment, paper powder can be reduced in generation amount for a medium ready to cause paper powder by permitting to use only one ejection opening out of the two, adjacent ejection openings in the same scanning and not permitting to use the other ejection opening.

Third Embodiment

In the above embodiment, the ejection openings were equal in ink ejection amount between the arrays thereof as shown in FIG. 22. However, the invention may be a printing head having ejection openings different in ink ejection amount between the arrays thereof.

Figure 27:
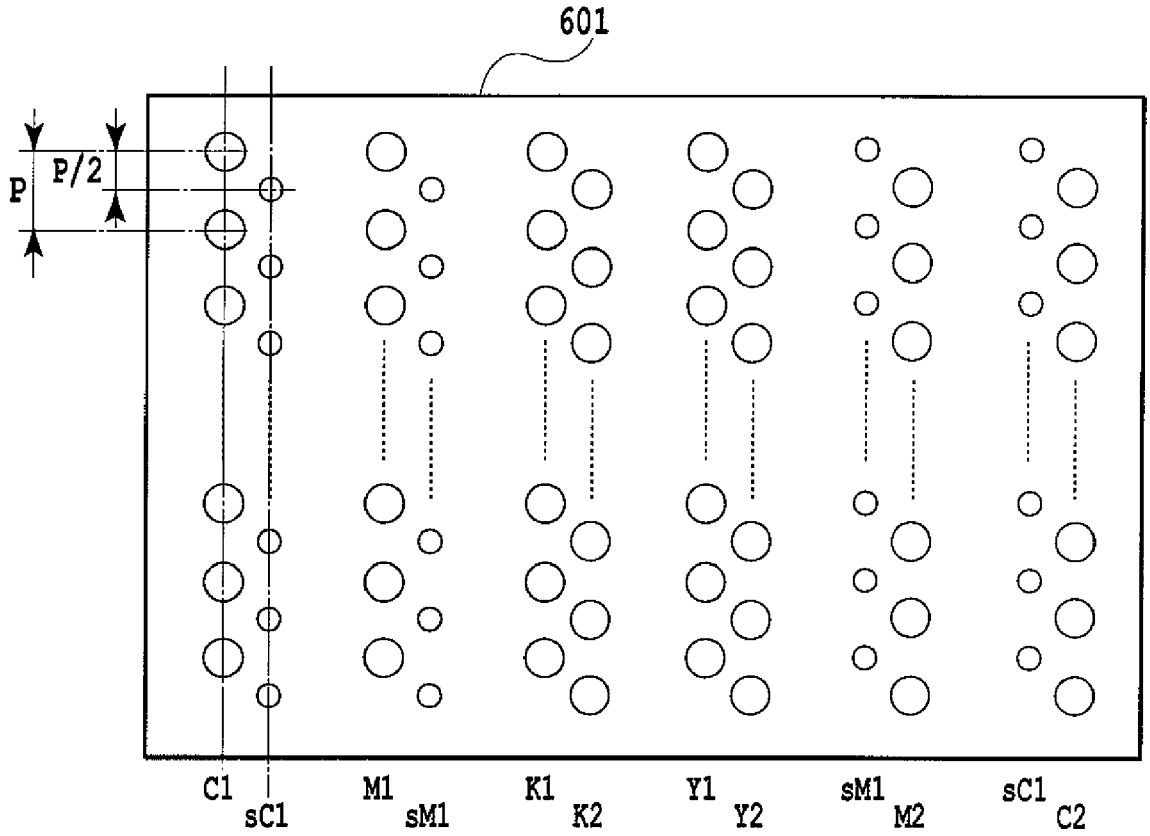
FIG. 27 is a view typically showing ejection-opening arrays, for respective ink colors in the printing head, for use in a third embodiment of the invention.

FIG. 27 is a view typically showing the ejection-opening arrays respectively for ink colors according to the embodiment. The embodiment uses four colors, or CMYK, of ink. As shown in the figure, two types of ejection openings different in ejection amount are provided for two types, or C and M, of ink. Specifically, two types of ejection amount, i.e. 5 pl (pl=$10^{-12}$ l) and 2 pl, are provided wherein arrays C1, C2 are with 5 pl ejection openings while arrays sC1, sC2 are with 2 pl ejection openings. Likewise, arrays M1, M2 are with 5 pl ejection openings while arrays sM1, sM2 are with 2 pl ejection openings. Meanwhile, Y and K are to be ejected through only the ejection openings each having 5 pl, on the arrays Y1 and Y2 as well as K1 and K2. The arrays for C and M are arranged symmetric about the arrays for Y and K. This arrangement of ejection openings is to make identical the colors of ink in arrival sequence at a printing medium in forward scanning and backward scanning during a bi-directional printing that the printing head is to be reciprocated in the main scanning direction.

Meanwhile, the reason of providing two types of ejection amount as 5 pl and 2 pl is because of improving the granularity in the low shade region of an image. Namely, image is formed in a low shade region mainly with 2 pl that is gradually replaced with 5 pl as going from a middle shade region to a high shade region, thus being finally formed only with 5 pl. When to form the image in the middle shade region and the subsequent only with 2 pl, there is a need to increase the area factor by raising the ejection frequency or increasing the number of scans for multi-pass print. However, if raising the ejection frequency, ink refill is not kept up therewith thus not allowing for normal ejection. Thus, the ejection frequency cannot be improved greatly. Meanwhile, increasing the number of scans for multi-pass print undesirably lowers the speed of printing. Therefore, by forming an image with two types, or 2 pl and 5 pl, of ejection amount, the printing head is allowed for printing at high speed while suppressing the granularity in the low shade region thereof.

Where making a printing by using the printing head according to the invention, there is a possibility of raising a problem that paper powder soars from a fine art paper under the influence of the airflow occurring upon the simultaneous use of two arrays of ejection openings. For example, an airflow winding up a paper powder arises between the two arrays C1 and sC1, under the interaction of an airflow caused by ejecting 5 pl ink droplets through the array C1, between the two arrays C1 and sC1, and an airflow caused by ejecting 2 pl ink droplets through the array sC1.

Accordingly, in the present embodiment, where selecting a printing medium ready to produce a paper powder, e.g. a fine art paper, an image is formed only with a smaller ejection amount, i.e. 2 pl, of ink droplets out of the two types of ejection amount. Meanwhile, where selecting another type of a printing medium not ready to produce a paper powder, an image is formed by use of both the two types of ejection amount.

In this case, when making a printing on a fine art paper, 2 pl ejection-opening arrays only are used as to C and M whereas a 5 pl ejection-opening array only is provided as to Y and K. Therefore, as for Y and K, printing is performed by such a printing method as not to soar a paper powder according to the method explained in embodiment 1 or 2.

In the explanation made so far, image forming is by use of only the 2 pl arrays of ejection openings when making a printing on a fine art paper. Alternatively, image forming may be by use of 5 pl arrays of ejection openings with a priority to the speed of printing.

Other Embodiments

The embodiments used the serial type printing apparatus having moving means that moves the printing head in the main scanning direction and conveying means that conveys a printing medium in a sub-scanning direction intersecting with the main scanning direction. However, the invention may be of so-called a full-line type printing apparatus that prints an image by use of an elongate printing head extending over the entire width range of a printing area of a printing medium. Namely, the ink jet printing apparatus is satisfactorily allowed to print an image on a printing medium by performing the relative movement of the printing head and the printing medium. In this case, the relative movement is performed in a direction (second direction) intersecting with an arrangement direction (first direction) of the ink ejection openings. Although the printing in the embodiment was under control of the control means provided on the main board of the printing apparatus, it maybe partly or wholly performed on the host side.

Meanwhile, although explanation was on the case that a paper powder of a fine art paper is to scatter, the scattering matter is not restricted to a paper powder but may be a substance of a material, etc. coated over a surface of a printing medium and to be scattered from the surface of the printing medium by ink ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-338099, filed Dec. 15, 2006, which is hereby incorporated by reference herein in its entirety.

What is claimed is:

1. An ink jet printing apparatus for printing an image on a printing medium by using a printing head having a plurality of arrays each having a plurality of ink ejection openings arranged in an arrangement direction, the apparatus comprising:

a moving device that performs a relative movement of the printing medium and the printing head, by moving the printing head in a direction intersecting with the arrangement direction of the ink ejection openings; and a printing device for printing an image during the relative movement by using ink ejection openings from at least one of two arrays adjacent to each other along the direction intersecting with the arrangement direction of the ink ejection openings, where a number of ink ejection openings used for printing is changed in accordance a type of the printing medium, wherein when the printing medium is a first type of printing medium, having a generation amount of a scattering substance produced when an image is printed thereon smaller than a second type of printing medium, the number of ink ejection openings used by the printing device is more than when the printing medium is the second type of printing medium, and wherein the printing device prints by using the ink ejection openings in both of the two arrays during the relative movement when the printing medium is the first type of printing medium, and prints by using the ink ejection openings in one of the two arrays during the relative movement when the printing medium is the second type of printing medium.

2. An ink jet printing apparatus according to claim 1, wherein the scattering substance is a paper powder.

3. An ink jet printing apparatus according to claim 1, wherein the printing device alternates between use of the ink ejection openings from one of the two arrays and the ink ejection openings from the other of the two arrays, when printing on the second type of printing medium.

4. An ink jet printing apparatus according to claim 1, wherein, of the two arrays, the ink ejection openings in one array and the ink ejection openings in the other array are different in ink ejection amount.

5. An ink jet printing apparatus according to claim 1, wherein the two arrays have respective ink ejection openings to eject a same one of ink.

6. An ink jet printing apparatus for printing an image on a printing medium by using a printing head having a plurality of arrays each having a plurality of ink ejection openings arranged in an arrangement direction, the apparatus comprising:

a moving device that performs a relative movement of the printing medium and the printing head, by moving the printing head in a direction intersecting with the arrangement direction of the ink ejection openings; and a printing device for printing an image during the relative movement by using ink ejection openings from at least one of two arrays adjacent to each other along the direction intersecting with the arrangement direction of the ink ejection openings, where a number of ink ejection openings used for printing is changed in accordance a type of the printing medium, wherein when the printing medium is a first type of printing medium, having a generation amount of a scattering substance produced when an image is printed thereon smaller than a second type of printing medium, the number of ink ejection openings used by the printing device is greater than when the printing medium is the second type of printing medium, and wherein the printing device prints by using adjacent ink ejection openings from the two arrays during the relative movement when the printing medium is the first type of printing medium, and prints by using one of the adjacent ink ejection openings during the relative movement when the printing medium is the second type of printing medium.

7. An ink jet printing method for printing an image on a printing medium, the method comprising:

performing a relative movement of the printing medium and a printing head, having a plurality of arrays each having a plurality of ink ejection openings arranged in an arrangement direction, by moving the printing head in a direction intersecting with the arrangement direction of the ink ejection openings; and printing an image during the relative movement by using ink ejection openings from at least one of two arrays adjacent to each other along the direction intersecting with the arrangement direction of the ink ejection openings, where a number of ink ejection openings used to print the image is changed in accordance with a type of printing medium, wherein when the printing medium is a first type of printing medium, having a generation amount of a scattering substance produced when the image is printed thereon smaller than a second type of printing medium, the number of ink ejection openings used is greater than when the printing medium is the second type of printing medium, and wherein the printing is performed in the printing step by using the ink ejection openings in both of the two arrays during the relative movement when the printing medium is the first type of printing medium, and the printing is performed in the printing step by using the ink ejection openings in one of the two arrays during the relative movement when the printing medium is the second type of printing medium.

* * * * *